US010777213B2

(12) United States Patent
Atti et al.

(10) Patent No.: US 10,777,213 B2
(45) **Date of Patent: *Sep. 15, 2020**

(54) AUDIO BANDWIDTH SELECTION

(71) Applicant: QUALCOMM Incorporated, San Diego, CA (US)

(72) Inventors: Venkatraman S. Atti, San Diego, CA (US); Venkata Subrahmanyam Chandra Sekhar Chebiyyam, Santa Clara, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 179 days.

This patent is subject to a terminal disclaimer.

(21) Appl. No.: 16/054,931

(22) Filed: Aug. 3, 2018

(65) Prior Publication Data

US 2018/0342255 A1 Nov. 29, 2018

Related U.S. Application Data

(63) Continuation of application No. 15/083,717, filed on Mar. 29, 2016, now Pat. No. 10,049,684.

(Continued)

(51) Int. Cl.
*G10L 19/26* (2013.01)
*G10L 21/0316* (2013.01)

(52) U.S. Cl.
CPC ..... *G10L 19/26* (2013.01); *G10L 21/0316* (2013.01)

(58) Field of Classification Search
USPC ..... 704/211, 500–504
See application file for complete search history.

(56) References Cited

U.S. PATENT DOCUMENTS

2005/0149339 A1 7/2005 Tanaka et al.
2007/0265842 A1 * 11/2007 Jarvinen ..... G10L 25/78 704/214

(Continued)

FOREIGN PATENT DOCUMENTS

JP 2009503559 A 1/2009
JP 2011512564 A 4/2011

(Continued)

OTHER PUBLICATIONS

International Telecommunications Union, Telecommunication Standardization Sector of Itu (Itu-T), Series G Transmission Systems and Media, Digital Systems and Networks Digital Terminal Equipments—Coding of Analogue Signals by Methods Other Than Pcm, Wideband coding of speech of around 16kbit/s using Adaptive Multi-Rate Wideband (AMR-WB), (ITU-T Recommendation "G.722.2"), Jul. 2003, 71 pages.

(Continued)

*Primary Examiner* — Leonard Saint Cyr

(57) ABSTRACT

A device includes a receiver configured to receive an audio frame of an audio stream. The audio frame includes information that indicates a coded bandwidth of the audio frame. The device also includes a decoder configured to generate first decoded speech associated with the audio frame and to determine an output mode of the decoder based at least in part on the information that indicates the coded bandwidth. A bandwidth mode indicated by the output mode of the decoder is different than a bandwidth mode indicated by the information that indicates the coded bandwidth. The decoder is further configured to output second decoded speech based on the first decoded speech. The second decoded speech is generated according to an output mode of the decoder.

27 Claims, 8 Drawing Sheets

Related U.S. Application Data

(60) Provisional application No. 62/143,158, filed on Apr. 5, 2015.

(56) References Cited

U.S. PATENT DOCUMENTS

| | | | | |
|---|---|---|---|---|
| 2009/0281800 | A1 | 11/2009 | Leblanc et al. | |
| 2009/0306992 | A1 | 12/2009 | Ragot et al. | |
| 2011/0035213 | A1 | 2/2011 | Malenovsky et al. | |
| 2011/0040560 | A1 | 2/2011 | Setiawan et al. | |
| 2011/0294501 | A1* | 12/2011 | Wang | H04L 65/1043 455/426.1 |
| 2012/0095757 | A1 | 4/2012 | Gibbs et al. | |
| 2012/0095758 | A1 | 4/2012 | Gibbs et al. | |
| 2012/0173230 | A1* | 7/2012 | Miseki | G10L 19/18 704/205 |
| 2013/0282373 | A1 | 10/2013 | Visser et al. | |
| 2014/0229171 | A1 | 8/2014 | Atti et al. | |
| 2014/0236588 | A1 | 8/2014 | Subasingha et al. | |
| 2016/0293174 | A1 | 10/2016 | Atti et al. | |

FOREIGN PATENT DOCUMENTS

| | | | |
|---|---|---|---|
| KR | 101295729 | B1 | 8/2013 |
| WO | 2014118185 | A1 | 8/2014 |

OTHER PUBLICATIONS

International Search Report and Written Opinion—PCT/US2016/025053—ISA/EPO—dated Sep. 12, 2016.

Taiwan Search Report—TW105110643—TIPO—dated Nov. 23, 2018.

* cited by examiner

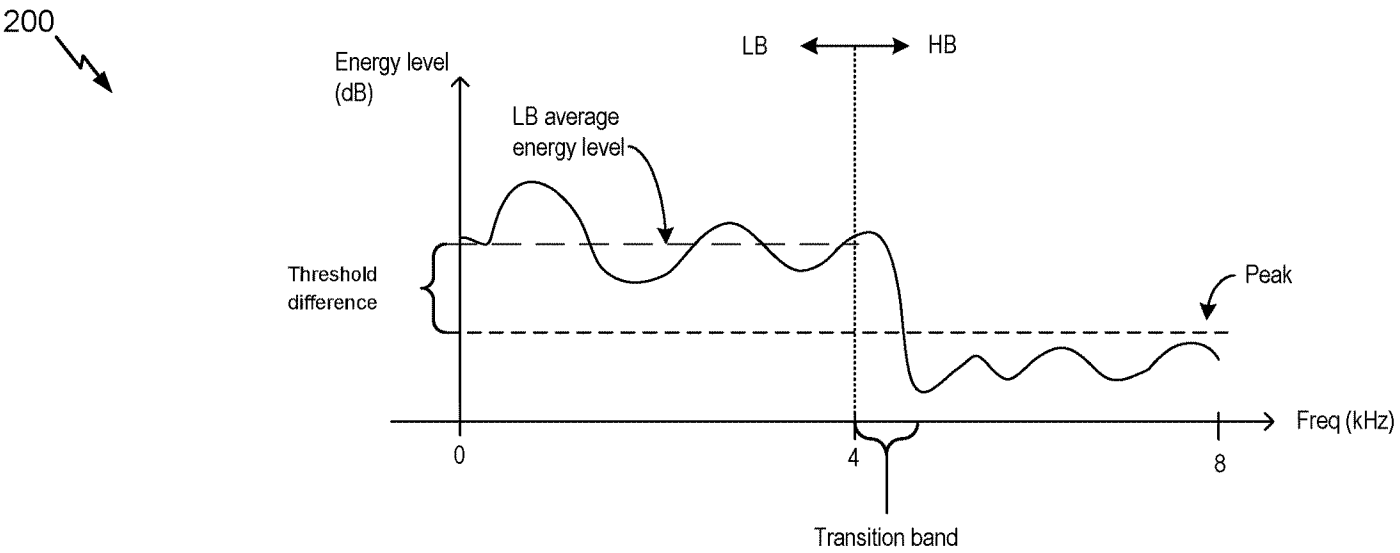
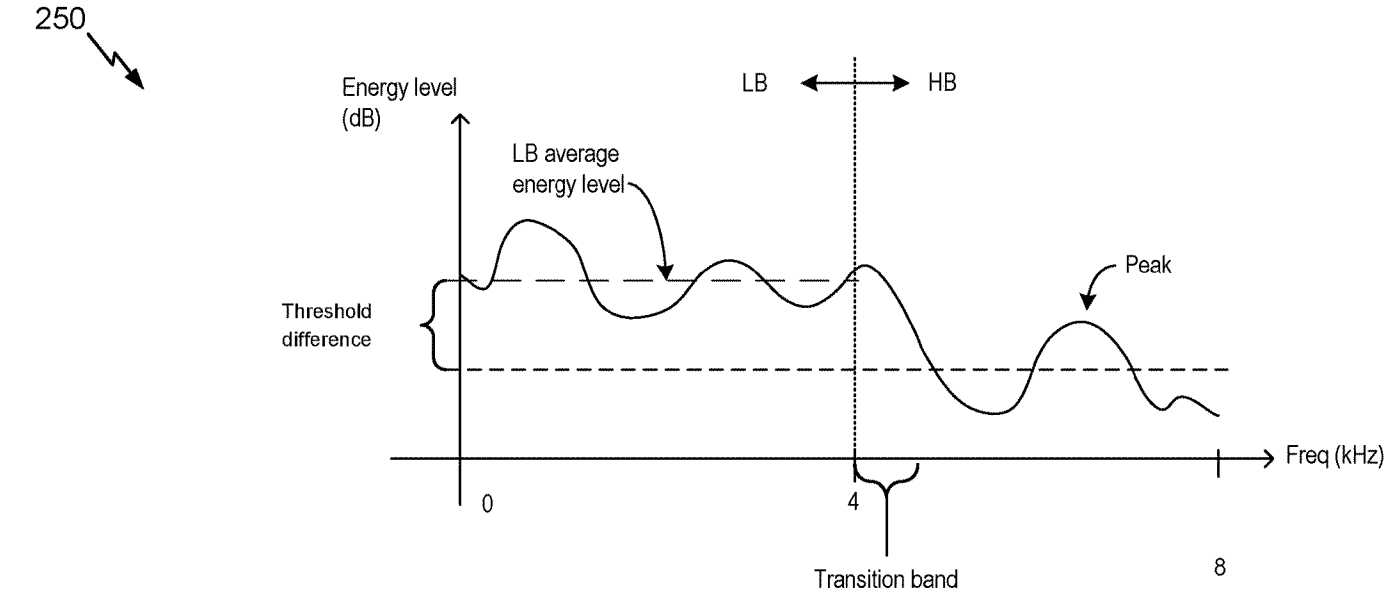
FIG. 2

300

| Audio frame sequence | ... | a | b | c | d | e | f | g | h | i | j |
|---|---|---|---|---|---|---|---|---|---|---|---|
| Classification | ... | NB | NB | NB | NB | WB | WB | WB | WB | WB | WB |
| Percent narrowband | ... | 86 | 88 | 90 | 92 | 90 | 88 | 86 | 84 | 82 | 80 |
| Adaptive threshold | ... | 90 | 90 | 90 | 83 | 83 | 83 | 83 | 83 | 83 | 90 |
| Output mode | ... | WB | WB | NB | NB | NB | NB | NB | NB | WB | WB |

350

| Audio frame sequence | ... | a | b | c | d | e | f | g | h | i |
|---|---|---|---|---|---|---|---|---|---|---|
| Classification | ... | NB | WB | WB | WB | WB | WB | WB | WB | WB |
| Percent narrowband | ... | 100 | 99.8 | 99.6 | 99.4 | 99.2 | 99 | 98.8 | 98.6 | N/A |
| Adaptive threshold | ... | 83 | 83 | 83 | 83 | 83 | 83 | 83 | 83 | 90 |
| Output mode | ... | NB | NB | NB | NB | NB | NB | NB | WB | WB |
| Count consecutive WB | ... | 0 | 1 | 2 | 3 | 4 | 5 | 6 | 7 | 8 |

*FIG. 3*

400

| Audio frame sequence | a | b | c | d | ... | av | aw | ax | ay |
|---|---|---|---|---|---|---|---|---|---|
| Classification | NB | WB | NB | WB | ... | NA | NB | NB | NB |
| Active frame count | 1 | 2 | 3 | 4 | ... | 48 | 49 | 50 | 51 |
| Percent narrowband | 100 | 50 | 67 | 50 | ... | 90 | 90.1 | 90.2 | 90.3 |
| Adaptive threshold | 90 | 90 | 90 | 90 | ... | 90 | 90 | 90 | 83 |
| Output mode | WB | WB | WB | WB | ... | WB | WB | NB | NB |

450

| Audio frame sequence | a | b | c | d | e | ... | aw | ax | ay | az | ba | bb | ... | bf | bg |
|---|---|---|---|---|---|---|---|---|---|---|---|---|---|---|---|
| Classification | N/A | NB | WB | NB | WB | ... | NA | NB | NB | NB | N/A | N/A | ... | N/A | NB |
| VAD (I=inactive; A=active) | I | A | A | A | A | ... | A | A | A | A | I | I | ... | I | A |
| Active frame count | 0 | 1 | 2 | 3 | 4 | ... | 48 | 49 | 50 | 51 | 51 | 51 | ... | 51 | 52 |
| Percent narrowband | N/A | 100 | 50 | 67 | 50 | ... | 90 | 90.1 | 90.2 | 90.3 | N/A | N/A | ... | N/A | 90.4 |
| Adaptive threshold | N/A | 90 | 90 | 90 | 90 | ... | 90 | 90 | 90 | 83 | N/A | N/A | ... | N/A | 83 |
| Output mode | WB | WB | WB | WB | WB | ... | WB | WB | NB | NB | NB | NB | ... | NB | NB |

*FIG. 4*

AUDIO BANDWIDTH SELECTION

I. CROSS REFERENCE TO RELATED APPLICATIONS

The present application claims the benefit of U.S. Provisional Patent Application No. 62/143,158, entitled "AUDIO BANDWIDTH SELECTION," filed Apr. 5, 2015, and is a continuation application of and claims priority from U.S. Non-Provisional patent application Ser. No. 15/083,717, entitled "AUDIO BANDWIDTH SELECTION," filed Mar. 29, 2016 and issued as U.S. Pat. No. 10,049,684 on Aug. 14, 2018; the contents of each of the aforementioned applications are expressly incorporated by reference herein in their entirety.

II. FIELD

The present disclosure is generally related to audio bandwidth selection.

III. DESCRIPTION OF RELATED ART

Transmission of audio content between devices may occur using one or more frequency ranges. The audio content may have a bandwidth that is less than an encoder bandwidth and less than a decoder bandwidth. After encoding and decoding the audio content, the decoded audio content may include spectral energy leakage into a frequency band above the bandwidth of the original audio content which may negatively impact a quality of the decoded audio content. For example, narrowband content (e.g., audio content within a first frequency range of 0-4 kilohertz (kHz)) may be encoded and decoded using a wideband coder that operates within a second frequency range of 0-8 kHz. When the narrowband content is encoded/decoded using the wideband coder, an output of the wideband coder may include spectral energy leakage in frequency bands above a bandwidth of the original narrowband signal. The noise may degrade an audio quality of the original narrowband content. Degraded audio quality may be magnified by non-linear power amplification or by dynamic range compression, which may be implemented in a voice processing chain of a mobile device that outputs the narrowband content.

IV. SUMMARY

In a particular aspect, a device includes a receiver configured to receive an audio frame of an audio stream. The device also includes a decoder configured to generate first decoded speech associated with the audio frame and to determine a count of audio frames classified as being associated with band limited content. The decoder is further configured to output second decoded speech based on the first decoded speech. The second decoded speech may be generated according to an output mode of the decoder. The output mode may be selected based at least in part on the count of audio frames.

In another particular aspect, a method includes generating, at a decoder, first decoded speech associated with an audio frame of an audio stream. The method also includes determining an output mode of the decoder based at least in part on a number of audio frames classified as being associated with band limited content. The method further includes outputting second decoded speech based on the first decoded speech. The second decoded speech may be generated according to the output mode.

In another particular aspect, a method includes receiving multiple audio frames of an audio stream at a decoder. The method further includes determining, at the decoder, a metric corresponding to a relative count of audio frames of the multiple audio frames that are associated with band limited content in response to receiving a first audio frame. The method also includes selecting a threshold based on an output mode of the decoder and updating the output mode from a first mode to a second mode based on a comparison of the metric to the threshold.

In another particular aspect, a method includes receiving a first audio frame of an audio stream at a decoder. The method also includes determining a number of consecutive audio frames including the first audio frame that are received at the decoder and that are classified as being associated with wideband content. The method further includes determining an output mode associated with the first audio frame to be a wideband mode in response to the number of consecutive audio frames being greater than or equal to a threshold.

In another particular aspect, an apparatus includes means for generating first decoded speech associated with an audio frame of an audio stream. The apparatus also includes means for determining an output mode of a decoder based at least in part on a number of audio frames classified as being associated with band limited content. The apparatus further includes means for outputting second decoded speech based on the first decoded speech. The second decoded speech may be generated according to the output mode.

In another particular aspect, a computer-readable storage device storing instructions that, when executed by a processor, cause the processor to perform operations including generating first decoded speech associated with an audio frame of an audio stream and determining an output mode of a decoder based at least in part on a count of audio frames classified as being associated with band limited content. The operations also include outputting second decoded speech based on the first decoded speech. The second decoded speech may be generated according to the output mode.

Other aspects, advantages, and features of the present disclosure will become apparent after review of the application, including the following sections: Brief Description of the Drawings, Detailed Description, and the Claims.

V. BRIEF DESCRIPTION OF THE DRAWINGS

FIG. 1 is a block diagram of an example of a system that includes a decoder and that is operable to select an output mode based on audio frames;

FIG. 2 includes graphs illustrating an example of classification of an audio frame based on bandwidth;

FIG. 3 includes tables to illustrate aspects of operation of the decoder of FIG. 1;

FIG. 4 includes tables to illustrate aspects of operation of the decoder of FIG. 1;

VI. DETAILED DESCRIPTION

Figure 1:
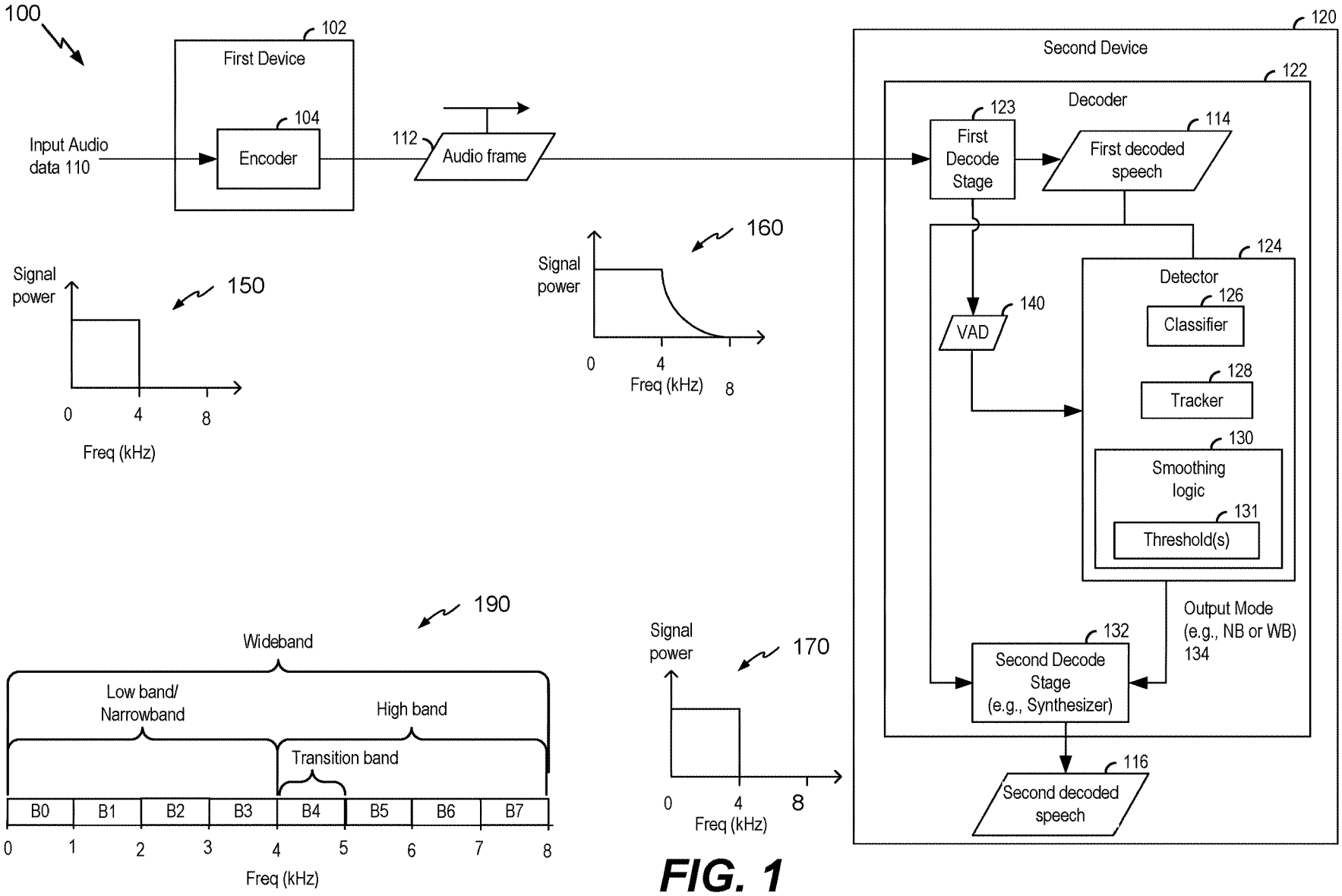

Particular aspects of the present disclosure are described below with reference to the drawings. In the description, common features are designated by common reference numbers. As used herein, various terminology is used for the purpose of describing particular implementations only and is not intended to be limiting of implementations. For example, the singular forms "a," "an," and "the" are intended to include the plural forms as well, unless the context clearly indicates otherwise. It may be further understood that the terms "comprises" and "comprising" may be used interchangeably with "includes" or "including." Additionally, it will be understood that the term "wherein" may be used interchangeably with "where." As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to one or more of a particular element, and the term "plurality" refers to multiple (e.g., two or more) of a particular element.

In the present disclosure, audio packets (e.g., encoded audio frames) received at a decoder may be decoded to generate decoded speech associated with a frequency range, such as a wideband frequency range. The decoder may detect whether the decoded speech includes band limited content associated with a first sub-range (e.g., a low band) of the frequency range. If the decoded speech includes the band limited content, the decoder may further process the decoded speech to remove audio content associated with a second-sub range (e.g., a high band) of the frequency range. By removing the audio content (e.g., spectral energy leakage) associated with the high band, the decoder may output band limited (e.g., narrowband) speech despite initially decoding the audio packets to have a larger bandwidth (e.g., over the wideband frequency range). Additionally, by removing the audio content (e.g., the spectral energy leakage) associated with the high band, an audio quality after encoding and decoding band limited content may be improved (e.g., by attenuating the spectral leakage over the input signal bandwidth).

To illustrate, for each audio frame received at the decoder, the decoder may classify the audio frame as being associated with wideband content or narrowband content (e.g., narrowband band limited content). For example, for a particular audio frame, the decoder may determine a first energy value associated with the low band and may determine a second energy value associated with the high band. In some implementations, the first energy value may be associated with an average energy value of the low band and the second energy value may be associated with a peak energy value of the high band. If the ratio of the first energy value and the second energy value is greater than a threshold (e.g., 512), the particular frame may be classified as being associated with band limited content. In the decibel (dB) domain, this ratio could be interpreted as a difference. (e.g., (first energy)/(second energy)>512 is equivalent to $10*\log_{10}$(first energy/second energy)=$10*\log_{10}$(first energy)−$10*\log_{10}$(second energy)>27.097 dB).

An output mode, such as an output speech mode (e.g., a wideband mode or a band limited mode), of the decoder may be selected based on classifiers of multiple audio frames. For example, the output mode may correspond to an operational mode of a synthesizer of the decoder, such as a synthesis mode of a synthesizer of the decoder. To select the output mode, the decoder may identify a group of recently received audio frames and determine a number of frames classified as being associated with band limited content. If the output mode is set to the wideband mode, the number of frames classified as having band limited content may be compared to a particular threshold. The output mode may be changed from the wideband mode to the band limited mode if the number of frames associated with band limited content is greater than or equal to the particular threshold. If the output mode is set to the band limited mode (e.g., a narrowband mode), the number of frames classified as having band limited content may be compared to a second threshold. The second threshold may be a lower value than the particular threshold. The output mode may be changed from the band limited mode to the wideband mode if the number of frames is less than or equal to the second threshold. By using different thresholds based on the output mode, the decoder may provide hysteresis that may help avoid frequently switching between different output modes. For example, if a single threshold were implemented, the output mode would frequently switch between the wideband mode and the band limited mode when the number of frames oscillate back and forth on a frame-by-frame basis between being greater than or equal to the single threshold and less than the single threshold.

Additionally or alternatively, the output mode may be changed from the band limited mode to the wideband mode in response to the decoder receiving a particular number of consecutive audio frames that are classified as wideband audio frames. For example, the decoder may monitor received audio frames to detect a particular number of consecutively received audio frames classified as wideband frames. If the output mode is the band limited mode (e.g., a narrowband mode) and the particular number of consecutively received audio frames is greater than or equal to a threshold value (e.g., 20), the decoder may transition the output mode from the band limited mode to the wideband mode. By transitioning from the band limited output mode to the wideband output mode, the decoder may provide wideband content that would otherwise be suppressed if the decoder remained in the band limited output mode.

One particular advantage provided by at least one of the disclosed aspects is that a decoder configured to decode audio frames over a wideband frequency range may selectively output band limited content over a narrowband frequency range. For example, the decoder may selectively output band limited content by removing spectral energy leakage of a high band frequency. Removing the spectral energy leakage may reduce degradation of an audio quality of the band limited content that would otherwise be experience if the spectral energy leakage were not removed. Additionally, the decoder may use different thresholds to determine when to switch the output mode from the wideband mode to the band limited mode and when to switch from the band limited mode to the wideband mode. By using different thresholds, the decoder may avoid repeatedly transitioning between multiple modes during short periods of time. Additionally, by monitoring received audio frames to detect a particular number of consecutively received audio frames classified as wideband frames, the decoder may quickly transition from the band limited mode to the wideband mode to provide wideband content that would otherwise be suppressed if the decoder remained in the band limited mode.

Referring to FIG. 1, a particular illustrative aspect of a system operable to detect band limited content is disclosed and generally designated 100. The system 100 may include a first device 102 (e.g., a source device) and a second device 120 (e.g., a destination device). The first device 102 may include an encoder 104 and the second device 120 may include a decoder 122. The first device 102 may be in communication with the second device 120 via a network (not shown). For example, the first device 102 may be configured to transmit audio data, such as an audio frame 112 (e.g., encoded audio data), to the second device 120. Additionally or alternatively, the second device 120 may be configured to transmit audio data to the first device 102.

The first device 102 may be configured to use the encoder 104 to encode input audio data 110 (e.g., speech data). For example, the encoder 104 may be configured to encode input audio data 110 (e.g., speech data wirelessly received via a remote microphone or a microphone local to the first device 102) to generate an audio frame 112. The encoder 104 may analyze the input audio data 110 to extract one or more parameters and may quantize the parameters into binary representation, e.g., into a set of bits or a binary data packet, such as the audio frame 112. To illustrate, the encoder 104 may be configured to compress, divide, or both, a speech signal into blocks of time to generate frames. The duration of each block of time (or "frame") may be selected to be short enough that the spectral envelope of the signal may be expected to remain relatively stationary. In some implementations, the first device 102 may include multiple encoders, such as the encoder 104 that is configured to encode speech content and another encoder (not shown) that is configured to encode non-speech content (e.g., music content).

The encoder 104 may be configured to sample the input audio data 110 at a sampling rate (Fs). The sampling rate (Fs) in Hertz (Hz) is a number of samples per second of the input audio data 110. A signal bandwidth of the input audio data 110 (e.g., the input content) may theoretically be between zero (0) and one-half of the sampling rate (Fs/2), such as a range of [0, (Fs/2)]. If the signal bandwidth is less than Fs/2, the input signal (e.g., the input audio data 110) may be referred to as band limited. Additionally, content of a band limited signal may be referred to as band limited content.

A coded bandwidth may indicate a frequency range that an audio coder (CODEC) codes. In some implementations, the audio coder (CODEC) may include an encoder, such as the encoder 104, a decoder, such as the decoder 122, or both. As described herein, examples of the system 100 are provided using the sampling rate of decoded speech as 16 kilohertz (kHz) that enables a signal bandwidth possible of 8 kHz. A bandwidth of 8 kHz may correspond to wideband ("WB"). A coded bandwidth of 4 kHz may correspond to narrowband ("NB") and may indicate that information within a range of 0-4 kHz is coded and other information outside of the range of 0-4 kHz is discarded.

In some aspects, the encoder 104 may provide an encoded bandwidth that is equal to a signal bandwidth of the input audio data 110. If a coded bandwidth is greater than a signal bandwidth (e.g., an input signal bandwidth), signal encoding and transmission may have reduced efficiency due to data being used to encode content of frequency ranges where the input audio data 110 does not include signal information. Additionally, if the coded bandwidth is greater than the signal bandwidth, in cases where a time-domain coder, such as algebraic code-excited linear prediction (ACELP) coder, is used, energy leakage may occur into a region of frequencies above the signal bandwidth where an input signal has no energy. The spectral energy leakage may be detrimental to a signal quality associated with the coded signal. Alternatively, if the coded bandwidth is less than the input signal bandwidth, the coder may not transmit an entirety of information included in the input signal (e.g., information included in the input signal at frequencies above Fs/2 may be omitted in the coded signal). Transmitting less than entirety of the information of the input signal may reduce intelligibility and liveliness of decoded speech.

In some implementations, the encoder 104 may include or correspond to an adaptive multi-rate wideband (AMR-WB) encoder. The AMR-WB encoder may have a coding bandwidth of 8 kHz, and the input audio data 110 may have an input signal bandwidth that is less than the coding bandwidth. To illustrate, the input audio data 110 may correspond to a NB input signal (e.g., NB content), as illustrated in graph 150. In the graph 150, the NB input signal has zero energy (i.e., does not include spectral energy leakage) in the 4-8 kHz region. The encoder 104 (e.g., the AMR-WB encoder) may generate the audio frame 112 that, when decoded, includes leakage energy in the 4-8 kHz range, in the graph 160. In some implementations, the input audio data 110 may be received at the first device 102 in a wireless communication from a device (not shown) coupled to the first device 102. Alternatively, the input audio data 110 may include audio data received by the first device 102, such as via a microphone of the first device 102. In some implementations, the input audio data 110 may be included in an audio stream. A portion of the audio stream may be received from a device coupled to the first device 102 and another portion of the audio stream may be received via the microphone of the first device 102.

In other implementations, the encoder 104 may include or correspond to an enhanced voice services (EVS) CODEC that has an AMR-WB interoperability mode. When configured to operate in the AMR-WB interoperability mode, the encoder 104 may be configured to support the same coding bandwidth as the AMR-WB encoder.

The audio frame 112 may be transmitted (e.g., wirelessly transmitted) from the first device 102 to the second device 120. For example, the audio frame 112 may be transmitted over a communication channel, such as a wired network connection, a wireless network connection, or a combination thereof, to a receiver (not shown) of the second device 120. In some implementations, the audio frame 112 may be included in a series of audio frames (e.g., the audio stream) transmitted from the first device 102 to the second device 120. In some implementations, information that indicates a coded bandwidth corresponding to the audio frame 112 may be included in the audio frame 112. The audio frame 112 may be communicated via a wireless network that is based on a 3rd Generation Partnership Project (3GPP) EVS protocol.

The second device 120 may include a decoder 122 that is configured to receive the audio frame 112 via a receiver of the second device 120. In some implementations, the decoder 122 may be configured to receive an output of the AMR-WB encoder. For example, the decoder 122 may include an EVS CODEC that has an AMR-WB interoperability mode. When configured to operate in the AMR-WB interoperability mode, the decoder 122 may be configured to support the same coding bandwidth as the AMR-WB encoder. The decoder 122 may be configured to process the data packets (e.g., audio frames), to unquantize the processed data packets to produce audio parameters, and to resynthesize the speech frames using the unquantized audio parameters.

The decoder 122 may include a first decode stage 123, a detector 124, a second decode stage 132. The first decode stage 123 may be configured to process the audio frame 112 to generate first decoded speech 114 and a voice activity decision (VAD) 140. The first decoded speech 114 may be provided to the detector 124, to the second decode stage 132. The VAD 140 may be used by the decoder 122 to make one or more determinations, as described herein, may be output by the decoder 122 to one or more other components of the decoder 122, or a combination thereof.

The VAD 140 may indicate whether the audio frame 112 includes useful audio content. An example of useful audio content is active speech as opposed to just background noise during silence. For example, the decoder 122 may determine whether the audio frame 112 is active (e.g., includes active speech) based on the first decoded speech 114). The VAD 140 may be set to a value of 1 to indicate that a particular frame is an "active" or "useful". Alternatively, the VAD 140 may be set to a value of 0 to indicate that the particular frame is an "inactive" frame, such as a frame that is devoid of audio content (e.g., just includes background noise). Although the VAD 140 is described as being determined by the decoder 122, in other implementations, the VAD 140 may be determined by a component of the second device 120 that is distinct from the decoder 122 and may be provided to the decoder 122. Additionally or alternatively, although the VAD 140 is described as being based on the first decoded speech 114, in other implementations the VAD 140 may be based directly on the audio frame 112.

The detector 124 may be configured to classify the audio frame 112 (e.g., the first decoded speech 114) as being associated with wideband content or band limited content (e.g., narrowband content). For example, the decoder 122 may be configured to classify the audio frame 112 as a narrowband frame or a wideband frame. A classification of a narrowband frame may correspond to the audio frame 112 being classified as having (e.g., being associated with) band limited content. Based at least in part on the classification of the audio frame 112, the decoder 122 may select an output mode 134, such as a narrowband (NB) mode or a wideband (WB) mode. For example, the output mode may correspond to an operational mode (e.g., a synthesis mode) of a synthesizer of the decoder.

To illustrate, the detector 124 may include a classifier 126, a tracker 128, and smoothing logic 130. The classifier 126 may be configured to classify the audio frame as being associated with band limited content (e.g., NB content) or wideband content (e.g., WB content). In some implementations, the classifier 126 generates a classification for active frames but does not generate a classification of inactive frames.

To determine a classification of the audio frame 112, the classifier 126 may divide a frequency range of the first decoded speech 114 into multiple bands. An illustrative example 190 depicts the frequency range divided into bands. The frequency range (e.g., the wideband) may have a bandwidth of 0-8 kHz. The frequency range may include a low band (e.g., a narrowband) and a high band. The low band may correspond to a first sub-range (e.g., a first set), such as 0-4 kHz, of the frequency range (e.g., the narrowband). The high band may correspond to a second sub-range (e.g. a second set), such as 4-8 kHz, of the frequency range. The wideband may be divided into multiple bands, such as bands B0-B7. Each of the multiple bands may have the same bandwidth (e.g., a bandwidth of 1 kHz in the example 190). One or more bands of the high band may be designated as transition bands. At least one of the transition bands may be adjacent to the low band. Although the wideband is illustrated as being divided into 8 bands, in other implementations, the wideband may be divided into more than or fewer than 8 bands. For example, the wideband may be divided into 20 bands that each has a bandwidth of 400 Hz, as an illustrative, non-limiting example.

To illustrate operation of the classifier 126, the first decoded speech 114 (associated with the wideband) may be divided into 20 bands. The classifier 126 may determine a first energy metric associated with bands of the low band and a second energy metric associated with bands of the high band. For example, the first energy metric may be an average energy (or power) of the bands of the low band. As another example, the first energy metric may be an average energy of a subset of the bands of the low band. To illustrate, the subset may include bands within a frequency range of 800-3600 Hz. In some implementations, weight values (e.g., multipliers) may be applied to one or more bands of the low band prior to determining the first energy metric. Applying a weight value to a particular band may give more preference to the particular band when calculating the first energy metric. In some implementations, preference may be given to one or more bands of the low band that are proximate to the high band.

To determine an amount of energy that corresponds to a particular band, the classifier 126 may use a quadrature mirror filter bank, a band pass filter, a complex low delay filter bank, another component, or another technique. Additionally or alternatively, the classifier 126 may determine the amount of energy of the particular band by summing the squares of signal components for each band.

The second energy metric may be determined based on a peak energy value of one or more bands that constitute the high band (e.g., the one or more bands not including bands considered as transition bands). To further explain, to determine the peak energy, one or more transition bands of the high band may not be considered. The one or more transition bands may be ignored because the one or more transition bands may have more spectral leakage from low band content than other bands of the high band. Accordingly, the one or more transition bands may not be indicative of whether the high band includes meaningful content or just includes spectral energy leakage. For example, the peak energy value of the bands that constitute the high band may be a largest detected band energy value of the first decoded speech 114 above a transition band (e.g., the transition band having an upper limit of 4.4 kHz.

After the first energy metric (of the low band) and the second energy metric (of the high band) are determined, the classifier 126 may perform a comparison using the first energy metric and the second energy metric. For example, the classifier 126 may determine whether a ratio between the first energy metric and the second energy metric is greater than or equal to a threshold amount. If the ratio is greater than the threshold amount, the first decoded speech 114 may be determined to not have meaningful audio content in the high band (e.g., 4-8 kHz). For example, the high band may be determined to primarily include spectral leakage due to coding band limited content (of the low band). Accordingly, if the ratio is greater than the threshold amount, the audio frame 112 may be classified as having band limited content (e.g., NB content). If the ratio is less than or equal to the threshold amount, the audio frame 112 may be classified as being associated with wideband content (e.g., WB content).

The threshold amount may be a predetermined value, such as 512, as illustrative non-limiting examples. Alternatively, the threshold amount may be determined based on the first energy metric. For example, the threshold amount may be equal to the first energy metric divided by a value of 512. The value of 512 may correspond to approximately a 27 dB difference between the logarithm of first energy metric and the logarithm of second energy metric (e.g., $10*\log_{10}$(first energy metric)$-10*\log_{10}$(second energy metric)). In other implementations, a ratio of the first energy metric and the second energy metric may be calculated and compared to the threshold amount. Examples of audio signals classified as having band limited content and wideband content are described with reference to FIG. 2.

The tracker 128 may be configured to maintain a record of one or more classifications generated by the classifier 126. For example, the tracker 128 may include a memory, a buffer, or other data structure that may be configured to track classifications. To illustrate, the tracker 128 may include a buffer that is configured to maintain data corresponding a particular number (e.g., 100) of most recently generated classifiers (e.g., classification outputs of the classifier 126 for the 100 most recent frames). In some implementations, the tracker 128 may maintain a scalar value that is updated every frame (or every active frame). The scalar value may represent a long term metric of the relative count of frames classified by the classifier 126 to be associated with band limited (e.g., narrowband) content. For example, the scalar value (e.g., the long term metric) may indicate a percentage of received frames classified as being associated with band limited (e.g., narrowband) content. In some implementations, the tracker 128 may include one or more counters. For example, the tracker 128 may include a first counter to count a number of received frames (e.g., a number of active frames), a second counter configured to count a number of frames classified as having band limited content, a third counter configured to count a number of frames classified as having wideband content, or a combination thereof. Additionally or alternatively, the one or more counters may include a fourth counter to count a number of consecutively (and most recently) received frames classified as having band limited content, a fifth counter configured to count a number of consecutively (and most recently) received frames classified as having wideband content, or a combination thereof. In some implementations, at least one counter may be configured to be incremented. In other implementations, at least one counter may be configured to be decremented. In some implementations, tracker 128 may increment the count of the number of received active frames in response to the VAD 140 indicating that a particular frame is an active frame.

The smoothing logic 130 may be configured to determine the output mode 134, such as selecting the output mode 134 as one of a wideband mode and a band limited mode (e.g., a narrowband mode). For example, the smoothing logic 130 may be configured to determine the output mode 134 responsive to each audio frame (e.g., each active audio frame). The smoothing logic 130 may implement a long term approach to determining the output mode 134 so that the output mode 134 does not frequently alternate between the wideband mode and the band limited mode.

The smoothing logic 130 may determine the output mode 134 and may provide an indication of the output mode 134 to the second decode stage 132. The smoothing logic 130 may determine the output mode 134 based on one or more metrics provided by the tracker 128. The one or more metrics may include a number of received frames, a number of active frames (e.g., frames indicated by voice activity decision as active/useful), a number of frames classified as having band limited content, a number of frames classified as having wideband content, etc., as illustrative, non-limiting examples. The number of active frames may be measured as a number of frames indicated (e.g., classified) as "active/useful" by the VAD 140 from the last event where the output mode has been explicitly switched, such as being switched from the band limited mode to the wideband mode, from the beginning of a communication (e.g., a telephone call), whichever is the latest event. Additionally, the smoothing logic 130 may determine the output mode 134 based on a previous or existing (e.g., current) output mode and one or more thresholds 131.

In some implementations, the smoothing logic 130 may select the output mode 134 to be the wideband mode if the number of received frames is less than or equal to a first threshold number. In an additional or alternative implementation, the smoothing logic 130 may select the output mode 134 to be the wideband mode if the number of active frames is less than a second threshold. The first threshold number may have a value of 20, 50, 250, or 500, as illustrative, non-limiting examples. The second threshold number may have a value of 20, 50, 250, or 500, as illustrative, non-limiting examples. If the number of received frames is greater than the first threshold number, the smoothing logic 130 may determine the output mode 134 based on a number of frames classified as having band limited content, a number of frames classified as having wideband content, a long term metric of the relative count of frames classified by the classifier 126 to be associated with band limited content, a number of consecutively (and most recently) received frames classified as having wideband content, or a combination thereof. After the first threshold number is satisfied, the detector 124 may consider the tracker 128 to have accumulated enough classifications to enable the smoothing logic 130 to select the output mode 134, as described further herein.

To illustrate, in some implementations, the smoothing logic 130 may select the output mode 134 based on a comparison of the relative count of received frames classified as having band limited content as compared to an adaptive threshold. The relative count of received frames classified as having band limited content may be determined out of a total number of classifications tracked by the tracker 128. For example, the tracker 128 may be configured to track a particular number (e.g., 100) of the most recently classified active frames. To illustrate, the count of the number of received active frames may be capped at (e.g., limited to) the particular number. In some implementation, the number of received frames classified to be associated with band limited content may be represented as a ratio or a percentage to indicate the relative number of frames classified to be associated with band limited content. For example, the count of the number of received active frames may correspond to a group of one or more frames and the smoothing logic 130 may determine a percentage of the group one or more frames that are classified as being associated with band limited content. Accordingly, setting the count of the number of received frames to an initial value (e.g., a value of zero) may have the effect of resetting the percentage to a value of zero.

The adaptive threshold may be selected (e.g., set) by the smoothing logic 130 according to a previous output mode 134, such as a previous output mode applied to a previous audio frame processed by the decoder 122. For example, the previous output mode may be a most recently used output mode. If the previous output mode is the wideband content mode, the adaptive threshold may be selected as a first adaptive threshold. If the previous output mode is the band limited content mode, the adaptive threshold may be selected as a second adaptive threshold. A value of the first adaptive threshold may be greater than a value of second adaptive threshold. For example, the first adaptive threshold may be associated with a value of 90% and the second adaptive threshold may be associated with a value of 80%. As another example, the first adaptive threshold may be associated with a value of 80% and the second adaptive threshold may be associated with a value of 71%. Selecting the adaptive threshold as one of multiple threshold values based on the previous output mode may provide hysteresis that may help avoid the output mode 134 frequently switching between the wideband mode and the band limited mode.

If the adaptive threshold is the first adaptive threshold (e.g., the previous output mode is the wideband mode), the smoothing logic 130 may compare the number of received frames classified as having band limited content to the first adaptive threshold. If the number of received frames classified as having band limited content is greater than or equal to the first adaptive threshold, the smoothing logic 130 may select the output mode 134 to be the band limited mode. If the number of received frames classified as having band limited content is less than the first adaptive threshold, the smoothing logic 130 may maintain the previous output mode (e.g., the wideband mode) as the output mode 134.

If the adaptive threshold is the second adaptive threshold (e.g., the previous output mode is the band limited mode), the smoothing logic 130 may compare the number of received frames classified as having band limited content to the second adaptive threshold. If the number of received frames classified as having band limited content is less than or equal to the second adaptive threshold, the smoothing logic 130 may select the output mode 134 to be the wideband mode. If the number of received frames classified to being associated with band limited content is greater than the second adaptive threshold, the smoothing logic 130 may maintain the previous output mode (e.g., the band limited mode) as the output mode 134. By switching from the wideband mode to the band limited mode when the first adaptive threshold (e.g., the higher adaptive threshold) is satisfied, the detector 124 may provide a high probability that band limited content is being received by the decoder 122. Additionally, by switching from the band limited mode to the wideband mode when the second adaptive threshold (e.g., the lower adaptive threshold) is satisfied, the detector 124 may change the mode in response to a lower probability that band limited content is being received by the decoder 122.

Although, the smoothing logic 130 is described as using the number of received frames classified as having band limited content, in other implementations, the smoothing logic 130 may select the output mode 134 based on the relative count of received frames classified as having wideband content. For example, the smoothing logic 130 may compare the relative count of received frames classified as having wideband content to the adaptive threshold that is set as one of a third adaptive threshold and a fourth adaptive threshold. The third adaptive threshold may have a value associated with 10% and the fourth adaptive threshold may have a value associated with 20%. The smoothing logic 130 may compare the number of received frames classified as having wideband content to the third adaptive threshold when the previous output mode is the wideband mode. If the number of received frames classified as having wideband content is less than or equal to the third adaptive threshold, the smoothing logic 130 may select the output mode 134 to be the band limited mode, otherwise the output mode 134 may remain as the wideband mode. The smoothing logic 130 may compare the number of the number of received frames classified as having wideband content to the fourth adaptive threshold when the previous output mode is the narrowband mode. If the number of received frames classified as having wideband content is greater than or equal to the fourth adaptive threshold, the smoothing logic 130 may select the output mode 134 to be the wideband mode, otherwise the output mode 134 may remain as the band limited mode.

In some implementations, the smoothing logic 130 may determine the output mode 134 based on a number of consecutively (and most recently) received frames classified as having wideband content. For example, the tracker 128 may maintain a count of consecutively received active frames that are classified as being associated with wideband content (e.g., not classified as being associated with band limited content). In some implementations, the count may be based on (e.g., include) a current frame, such as the audio frame 112, as long as the current frame is identified as an active frame and is classified as being associated with wideband content. The smoothing logic 130 may obtain the count of consecutively received active frames classified as being associated with wideband content and may compare the count to a threshold number. The threshold number may have a value of 7 or 20, as illustrative, non-limiting examples. If the count is greater than or equal than the threshold number, the smoothing logic 130 may select the output mode 134 to be the wideband mode. In some implementations, the wideband mode may be considered the default mode of the output mode 134 and the output mode 134 could be left unchanged as the wideband mode when the count is greater than or equal to the threshold number.

Additionally or alternatively, in response to the number of consecutively (and most recently) received frames classified as having wideband content being greater than or equal to the threshold number, the smoothing logic 130 may cause a counter that tracks the number of received frames (e.g., a number of active frames) to be set to an initial value, such as a value of zero. Setting the counter that tracks the number of received frames (e.g., the number of active frames) to a value of zero may have the effect of forcing the output mode 134 to be set to the wideband mode. For example, the output mode 134 may be set to the wideband mode at least until the number of received frames (e.g., the number of active frames) is greater than the first threshold number. In some implementations, the count of the number of received frames may be set to the initial value anytime the output mode 134 is switched from the band limited mode (e.g., the narrowband mode) to the wideband mode. In some implementations, in response to the number of consecutively (and most recently) received frames classified as having wideband content being greater than or equal to the threshold number, the long term metric tracking the relative count of frames recently classified as having band limited content could be reset to an initial value, such as a value of zero. Alternatively, if the number of consecutively (and most recently) received frames classified as having wideband content is less than the threshold number, the smoothing logic 130 may make one or more other determinations, as described herein, to select the output mode 134 (associated with a received audio frame, such as the audio frame 112).

In addition, or alternatively, to the smoothing logic 130 comparing the count of consecutively received active frames classified as being associated with wideband content to the threshold number, the smoothing logic 130 may determine a number of previously received active frames being classified as having wideband content (e.g., not classified as having band limited content) out of a particular number of most recently received active frames. The particular number of most recently received active frames may be 20, as an illustrative, non-limiting example. The smoothing logic 130 may compare the number of previously received active frames being classified as having wideband content (out of a particular number of most recently received active frames) to a second threshold number (that may have the same or a different value than the adaptive threshold). In some implementations, the second threshold number is a fixed (e.g., not adaptive) threshold. In response to a determination that the number of previously received active frames being classified as having wideband content is determined to be greater than or equal to the second threshold number, the smoothing logic 130 may perform one or more of the same operations as described with reference to the smoothing logic 130 determining the count of consecutively received active frames classified as being associated with wideband content is greater than the threshold number. In response to a determination that the number of previously received active frames being classified as having wideband content is determined to be less than the second threshold number, the smoothing logic 130 may make one or more other determinations, as described herein, to select the output mode 134 (associated with a received audio frame, such as the audio frame 112).

In some implementations, in response to the VAD 140 indicating that the audio frame 112 is an active frame, the smoothing logic 130 may determine an average energy of the low band (or an average energy of a subset of bands of the low band) of the audio frame 112, such as an average low band energy (alternatively an average energy of a subset of bands of the low band) of the first decoded speech 114. The smoothing logic 130 may compare the average low band energy (or alternatively the average energy of a subset of bands of the low band) of the audio frame 112 to a threshold energy value, such as a long term metric. For example, the threshold energy value may be an average of the average low band energy value (or alternatively an average of the average energy of a subset of bands of the low band) of multiple previously received frames. In some implementations, the multiple previously received frames may include the audio frame 112. If the average energy value of the low band of the audio frame 112 is less than the average low band energy value of the multiple previously received frames, the tracker 128 may choose not to update the value corresponding to the long term metric of the relative count of frames classified by the classifier 126 to be associated with band limited content with the classification decision of 126 for the audio frame 112. Alternatively, if the average energy value of the low band of the audio frame 112 is greater than or equal to the average low band energy value of the multiple previously received frames, the tracker 128 may choose to update the value corresponding to the long term metric of the relative count of frames classified by the classifier 126 to be associated with band limited with the classification decision of 126 for the audio frame 112.

The second decode stage 132 may process the first decoded speech 114 according to the output mode 134. For example, the second decode stage 132 may receive the first decoded speech 114 and, according to the output mode 134, may output second decoded speech 116. To illustrate, if the output mode 134 corresponds to the WB mode, the second decode stage 132 may be configured to output (e.g., generate) the first decoded speech 114 as the second decoded speech 116. Alternatively, if the output mode 134 corresponds to the NB mode, the second decode stage 132 may selectively output a portion of the first decoded speech as the second decoded speech. For example, the second decode stage 132 may be configured to "zero out" or, alternatively, to attenuate high band content of the first decoded speech 114 and to perform a final synthesis on the low band content of the first decoded speech 114 to produce the second decoded speech 116. A graph 170 illustrates an example of the second decoded speech 116 having band limited content (and no high band content).

During operation, the second device 120 may receive a first audio frame of multiple audio frames. For example, the first audio frame may correspond to the audio frame 112. The VAD 140 (e.g., data) may indicate that the first audio frame is an active frame. In response to receiving the first audio frame, the classifier 126 may generate a first classification of the first audio frame to be a band limited frame (e.g., a narrowband frame). The first classification may be stored at the tracker 128. In response to receiving the first audio frame, the smoothing logic 130 may determine that a number of received audio frames is less than the first threshold number. Alternatively, the smoothing logic 130 may determine the number of active frames (measured as the number of frames indicated (e.g., identified) as "active/useful" by the VAD 140 from the last event when the output mode has been explicitly switched from band limited mode to wideband mode or from the beginning of the call, whichever is the latest event) is less than the second threshold number. Because the number of received audio frames is less than the first threshold number, the smoothing logic 130 may select a first output mode (e.g., a default mode) corresponding to the output mode 134 to be the wideband mode. The default mode may be selected if the number of received audio frames is less than the first threshold number, irrespective of a number of received frames that are associated with band limited content and irrespective of a number of consecutively received frames that have each been classified as having wideband content (e.g., not band limited content).

After the first audio frame is received, the second device may receive a second audio frame of the multiple audio frames. For example, the second audio frame may be a next received frame after the first audio frame. The VAD 140 may indicate that the second audio frame is an active frame. The number of received active audio frames may be incremented in response to the second audio frame being an active frame.

Based on the second audio frame being an active frame, the classifier 126 may generate a second classification of the second audio frame to be a band limited frame (e.g., a narrowband frame). The second classification may be stored at the tracker 128. In response to receiving the second audio frame, the smoothing logic 130 may determine that a number of received audio frames (e.g., received active audio frames) is greater than or equal to the first threshold number. (Note that the labels "first" and "second" distinguish between frames and do not necessarily denote an order or position of the frames in a sequence of received frames. For example, the first frame may be the $7^{th}$ frame that is received in a sequence of frames and the second frame may be the $8^{th}$ frame in the sequence of frames.) In response to the number of received audio frames being greater than the first threshold number, the smoothing logic 130 may set the adaptive threshold based on the previous output mode (e.g., the first output mode). For example, the adaptive threshold may be set to the first adaptive threshold because the first output mode was the wideband mode.

The smoothing logic 130 may compare the number of received frames classified as having band limited content to the first adaptive threshold. The smoothing logic 130 may determine that the number of received frames classified as having band limited content is greater than or equal to the first adaptive threshold and may set a second output mode corresponding to the second audio frame to be the band limited mode. For example, the smoothing logic 130 may update the output mode 134 to be the band limited content mode (e.g., the NB mode).

The decoder 122 of the second device 120 may be configured to receive multiple audio frames, such as the audio frame 112, and to identify one or more audio frames that have band limited content. Based on a number of frames classified as having band limited content (a number of frames classified as having wideband content, or both), the decoder 122 may be configured to selectively process received frames to generate and output decoded speech that includes band limited content (and does not include high band content). The decoder 122 may use the smoothing logic 130 to ensure that the decoder 122 is not frequently switching between outputting wideband decoded speech and band limited decoded speech. Additionally, by monitoring received audio frames to detect a particular number of consecutively received audio frames classified as wideband frames, the decoder 122 may quickly transition from the band limited output mode to the wideband output mode. By quickly transitioning from the band limited output mode to the wideband output mode, the decoder 122 may provide wideband content that would otherwise be suppressed if the decoder 122 remained in the band limited output mode. Use of the decoder 122 of FIG. 1 may lead to improved signal decoding quality as well as improved user experience.

FIG. 2 depicts graphs are depicted that illustrate classification of audio signals. Classification of the audio signals may be performed by the classifier 126 of FIG. 1. A first graph 200 illustrates classification of a first audio signal as including band limited content. In the first graph 200, a ratio between an average energy level of a low band portion of the first audio signal and a peak energy level of a high band portion (excluding a transition band) of the first audio signal is greater than a threshold ratio. A second graph 250 illustrates classification of a second audio signal as including wideband content. In the second graph 250, a ratio between an average energy level of a low band portion of the second audio signal and a peak energy level of a high band portion (excluding a transition band) of the second audio signal is less than a threshold ratio.

Referring to FIGS. 3 and 4, tables are depicted that illustrate values associated with operation of a decoder. The decoder may correspond to the decoder 122 of FIG. 1. As used in FIGS. 3-4, audio frame sequence indicates an order in which audio frames are received at the decoder. Classification indicates a classification that corresponds to a received audio frame. Each classification may be determined by the classifier 126 of FIG. 1. A classification of WB corresponds to a frame being classified as having wideband content and a classification of NB corresponds to a frame being classified as having band limited content. Percent narrowband indicates a percentage of recently received frames that have been classified as having band limited content. The percentage may be based on a number of recently received frames, such as 200 or 500 frames, as illustrative, non-limiting examples. Adaptive threshold indicates a threshold that may be applied to the percent narrowband for a particular frame to determine an output mode to be used to output audio content associated with the particular frame. Output mode indicates a mode (e.g., a wideband mode (WB) or a band limited (NB) mode) to be used to output audio content associated with a particular frame. The output mode may correspond to the output mode 134 of FIG. 1. Count consecutive WB may indicate a number of consecutively received frames that have been classified as having wideband content. Active frame count indicates a number of active frames received by the decoder. A frame may be identified as an active frame (A) or an inactive frame (I) by a VAD, such as the VAD 140 of FIG. 1.

A first table 300 illustrates changing of the output mode and changing of the adaptive threshold in response to a change in the output mode. For example, a frame (c) may be received and may be classified as being associated with band limited content (NB). In response to the frame (c) being received, the percent of narrowband frames may be greater or equal to the adaptive threshold of 90. Accordingly, the output mode is changed from WB to NB and the adaptive threshold may be updated to a value of 83 to be applied to a subsequently received frame, such as a frame (d). The adaptive value may be maintained at a value of 83 until the percent of narrowband frames is less than the adaptive threshold of 83 in response to a frame (i). In response to the percent of narrowband frames being less than the adaptive threshold of 83, the output mode is changed from NB to WB and the adaptive threshold may be updated to a value of 90 for a subsequently received frame, such as a frame (j). Thus, the first table 300 illustrates changing of the adaptive threshold.

A second table 350 illustrates that the output mode may be changed in response to a number of consecutively received frames that have been classified as having wideband content (count consecutive WB) being greater than or equal to a threshold value. For example, the threshold value may be equal to a value of 7. To illustrate, a frame (h) may be the seventh sequentially received frame that is classified as a wideband frame. In response to receiving the frame (h), the output mode may be switched from the band limited mode (NB) and set to the wideband mode (WB). Thus, the second table 350 illustrates changing the output mode responsive to the number of consecutively received frames that have been classified as having wideband content.

A third table 400 illustrates an implementation in which a comparison of the percentage of frames classified as having band limited content as compared to the adaptive threshold is not used to determine the output mode until a threshold number of active frames has been received by the decoder. For example, the threshold number of active frames may be equal to 50, as an illustrative, non-limiting example. Frames (a)-(aw) may correspond to an output mode associated with wideband content regardless of the percentage of frames classified as having band limited content. An output mode corresponding to a frame (ax) may be determined based on a comparison of the percentage of frames classified as having band limited content to the adaptive threshold because the active frame count may be greater than or equal to the threshold number (e.g., 50). Thus, the third table 400 illustrates prohibiting changing the output mode until the threshold number of active frames has been received.

A fourth table 450 illustrates an example of operation of a decoder in response to a frame being classified as an inactive frame. Additionally, the fourth table 450 illustrates that a comparison of the percentage of frames classified as having band limited content to the adaptive threshold is not used to determine the output mode until a threshold number of active frames has been received by the decoder. For example, the threshold number of active frames may be equal to 50, as an illustrative, non-limiting example.

The fourth table 450 illustrates that a classification may not be determined for a frame identified as an inactive frame. Additionally, a frame identified as inactive may not be considered to determine the percentage of frames having band limited content (percent narrowband). Accordingly, the adaptive threshold is not utilized in a comparison if a particular frame is identified as inactive. Further, an output mode of a frame identified as inactive may be the same output mode for a most recently received frame. Thus, the fourth table 450 illustrates decoder operation responsive to a sequence of frames that includes one or more frames that are identified as inactive frames.

Figure 5:
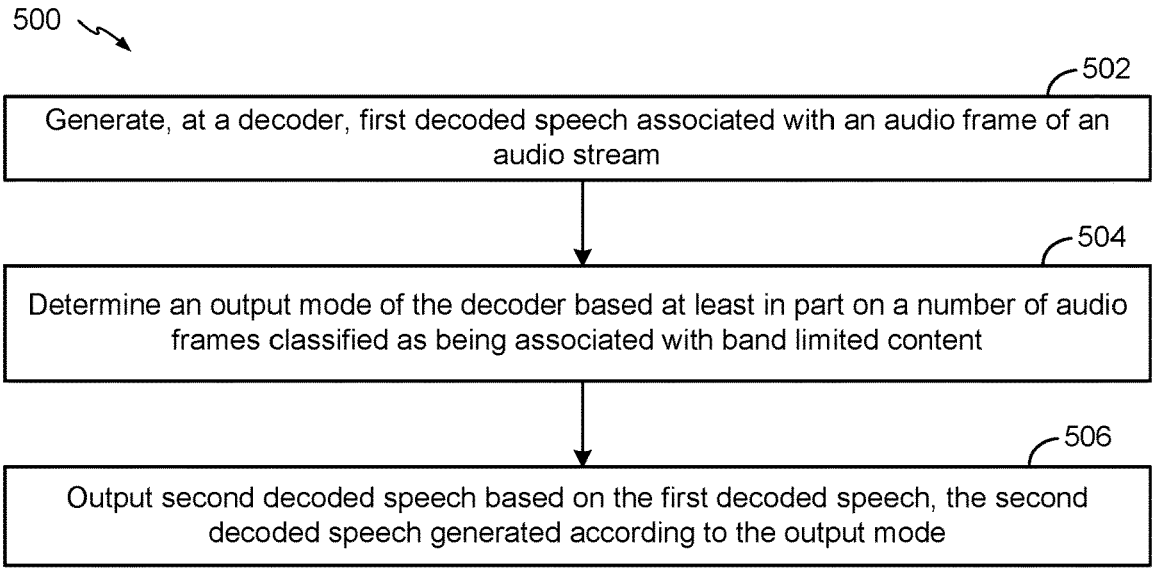
FIG. 5 is a flow chart illustrating an example of a method of operating a decoder.

Referring to FIG. 5, a flow chart of a particular illustrative example of a method of operating a decoder is disclosed and generally designated 500. The decoder may correspond to the decoder 122 of FIG. 1. For example, the method 500 may be performed by the second device 120 (e.g., the decoder 122, the first decode stage 123, the detector 124, the second decode stage 132) of FIG. 1, or a combination thereof.

The method 500 includes generating, at a decoder, first decoded speech associated with an audio frame of an audio stream, at 502. The audio frame and the first decoded speech may correspond to the audio frame 112 and the first decoded speech 114, respectively, of FIG. 1. The first decoded speech may include a low band component and a high band component. The high band component may correspond to spectral energy leakage.

The method 500 also includes determining an output mode of the decoder based at least in part on a number of audio frames classified as being associated with band limited content, at 504. For example, the output mode may correspond to the output mode 134 of FIG. 1. In some implementations, the output mode may be determined to be a narrowband mode or a wideband mode.

The method 500 further includes outputting second decoded speech based on the first decoded speech, the second decoded speech output according to the output mode, at 506. For example, the second decoded speech may include or correspond to the second decoded speech 116 of FIG. 1. If the output mode is the wideband mode, the second decoded speech may be substantially the same as the first decoded speech. For example, the bandwidth of the second decoded speech is substantially the same as the bandwidth of the first decoded speech if the second decoded speech is the same as or within a tolerance range of the first decoded speech. The tolerance range may correspond to a design tolerance, a manufacturing tolerance, an operational tolerance (e.g., a processing tolerance) associated with the decoder, or a combination thereof. If the output mode is the narrowband mode, outputting the second decoded speech may include maintaining a low band component of the first decoded speech and attenuating a high band component of the first decoded speech. Additionally or alternatively, if the output mode is the narrowband mode, outputting the second decoded speech may include attenuating one or more frequency bands associated with a high band component of the first decoded speech. In some implementations, the attenuation of the high band component or the attenuation of one or more of frequency bands associated with high band could mean "zeroing out" the high band component or "zeroing out" one or more of the frequency bands associated with high band content.

In some implementations, the method 500 may include determining a ratio value that is based on a first energy metric associated with the low band component and a second energy metric associated with the high band component. The method 500 may also include comparing the ratio value to a classification threshold and, in response to the ratio value being greater than the classification threshold, classifying the audio frame as being associated with the band limited content. If the audio frame is associated with the band limited content, outputting the second decoded speech may include attenuating the high band component of the first decoded speech to generate the second decoded speech. Alternatively, if the audio frame is associated with the band limited content, outputting the second decoded speech may include setting an energy value of one or more bands associated with the high band component to a particular value to generate the second decoded speech. As an illustrative, non-limiting example, the particular value may be zero.

In some implementations, the method 500 may include classifying the audio frame as a narrowband frame or a wideband frame. A classification of a narrowband frame corresponds to being associated with the band limited content. The method 500 may also include determining a metric value corresponding to a second count of audio frames of multiple audio frames that are associated with the band limited content. The multiple audio frames may correspond to an audio stream received at the second device 120 of FIG. 1. The multiple audio frames may include the audio frame (e.g., the audio frame 112 of FIG. 1) and the second audio frame. For example, the second count of audio frames that are associated with the band limited content may be maintained (e.g., stored) at the tracker 128 of FIG. 1. To illustrate, the second count of audio frames that are associated with the band limited content may correspond to a particular metric value maintained at the tracker 128 of FIG. 1. The method 500 may also include selecting a threshold, such as an adaptive threshold as described with reference to the system 100 of FIG. 1, based on the metric value (e.g., the second count of audio frames). To illustrate, the second count of audio frames may be used to select the output mode associated with the audio frame, and the adaptive threshold may be selected based on the output mode.

In some implementations, the method 500 may include determining a first energy metric associated with a first set of multiple frequency bands associated with a low band component of the first decoded speech and determining a second energy metric associated with a second set of multiple frequency bands associated with a high band component of the first decoded speech. Determining the first energy metric may include determining an average energy value of a subset of bands of the first set of multiple frequency bands and setting the first energy metric equal to the average energy value. Determining the second energy metric may include determining a particular frequency band of the second set of multiple frequency bands having a highest detected energy value of the second set of multiple frequency bands, and setting the second energy metric equal to the highest detected energy value. The first sub-range and the second sub-range may be mutually exclusive. In some implementations, the first sub-range and the second sub-range are separated by a transition band of the frequency range.

In some implementations, the method 500 may include, in response to receiving a second audio frame of the audio stream, determining a third count of consecutive audio frames that are received at the decoder and that are classified as having wideband content. For example, third count of consecutive audio frames having wideband content may be maintained (e.g., stored) at the tracker 128 of FIG. 1. The method 500 may further include updating the output mode to a wideband mode in response to the third count of consecutive audio frames having wideband content being greater than or equal to a threshold. To illustrate, if the output mode determined at 504 is associated with a band limited mode, the output mode may be updated to the wideband mode if the third count of consecutive audio frames having wideband content being greater than or equal to a threshold. Additionally, if the third count of consecutive audio frames is greater than or equal to the threshold, the output mode may be updated independent of a comparison that is based on the number of audio frames classified as having band limited content (or the number of frames classified as having wideband content) and the adaptive threshold.

In some implementations, the method 500 may include determining, at the decoder, a metric value corresponding to a relative count of second audio frames of multiple second audio frames that are associated with band limited content. In a particular implementation, determining the metric value may be performed in response to receiving the audio frame. For example, the classifier 126 of FIG. 1 may determine a metric value corresponding to a count of audio frames associated with band limited content, as described with reference to FIG. 1. The method 500 may also include selecting a threshold based on the output mode of the decoder. The output mode may be selectively updated from a first mode to a second mode based on a comparison of the metric value to the threshold. For example, the smoothing logic 130 of FIG. 1 may selectively update the output mode from the first mode to the second mode, as described with reference to FIG. 1.

In some implementations, the method 500 may include determining whether the audio frame is an active frame. For example, the VAD 140 of FIG. 1 may indicate whether an audio frame is active or inactive. In response to determining that the audio frame is an active frame, the output mode of the decoder may be determined.

In some implementations, the method 500 may include receiving a second audio frame of the audio stream at the decoder. For example, the decoder 122 may receive audio frame (b) of FIG. 3. The method 500 may also include determining whether the second audio frame is an inactive frame. The method 500 may further include maintaining the output mode of the decoder in response to determining that the second audio frame is an inactive frame. For example, the classifier 126 may not output a classification in response to the VAD 140 indicating that a second audio frame is an inactive frame, as described with reference to FIG. 1. As another example, the detector 124 may maintain a previous output mode and may not determine the output mode 134 for a second frame in response to the VAD 140 indicating that the second audio frame is an inactive frame, as described with reference to FIG. 1.

In some implementations, the method 500 may include receiving a second audio frame of the audio stream at the decoder. For example, the decoder 122 may receive audio frame (b) of FIG. 3. The method 500 may also include determining a number of consecutive audio frames including the second audio frame that are received at the decoder and that are classified as being associated with wideband content. For example, the tracker 128 of FIG. 1 may count and determine the number of consecutive audio frames classified as being associated with the wideband content, as described with reference to FIGS. 1 and 3. The method 500 may further include selecting a second output mode associated with the second audio frame to be a wideband mode in response to the number of consecutive audio frames classified as being associated with the wideband content being greater than or equal to a threshold. For example, the smoothing logic 130 of FIG. 1 may select the output mode in response to the number of consecutive audio frames classified as being associated with the wideband content being greater than or equal to a threshold, as described with reference to the second table 350 of FIG. 3.

In some implementations, the method 500 may include selecting a wideband mode as a second output mode associated with the second audio frame. The method 500 may also include updating the output mode associated with the second audio frame from a first mode to the wideband mode in response to selecting the wideband mode. The method 500 may further include setting a count of received audio frames to a first initial value, setting a metric value corresponding to a relative count of audio frames of the audio stream that are associated with band limited content to a second initial value, or both, in response to updating the output mode from the first mode to the wideband mode, as described with reference to the second table 350 of FIG. 3. In some implementations, the first initial value and the second initial value may be the same value, such as zero.

In some implementations, the method 500 may include receiving multiple audio frames of the audio stream at the decoder. The multiple audio frames may include the audio frame and a second audio frame. The method 500 may also include, in response to receiving the second audio frame, determining, at the decoder, a metric value corresponding to a relative count of audio frames of the multiple audio frames that are associated with band limited content. The method 500 may include selecting a threshold based on a first mode of the output mode of the decoder. The first mode may be associated with the audio frame received prior to the second audio frame. The method 500 may further include updating the output mode from the first mode to a second mode based on a comparison of the metric value to the threshold. The second mode may be associated with the second audio frame.

In some implementations, the method 500 may include determining, at the decoder, a metric value corresponding to the number of audio frames classified as being associated with band limited content. The method 500 may also include selecting a threshold based on a previous output mode of the decoder. The output mode of the decoder may further be determined based on a comparison of the metric value to the threshold.

In some implementations, the method 500 may include receiving a second audio frame of the audio stream at the decoder. The method 500 may also include determining a number of consecutive audio frames including the second audio frame that are received at the decoder and that are classified as being associated with wideband content. The method 500 may further include selecting a second output mode associated with the second audio frame to be a wideband mode in response to the number of consecutive audio frames being greater than or equal to a threshold.

The method 500 may thus enable the decoder to select the output mode with which to output audio content associated with the audio frame. For example, if the output mode is the narrowband mode, the decoder may output narrowband content associated with the audio frame and may refrain from outputting high band content associated with the audio frame.

Figure 6:
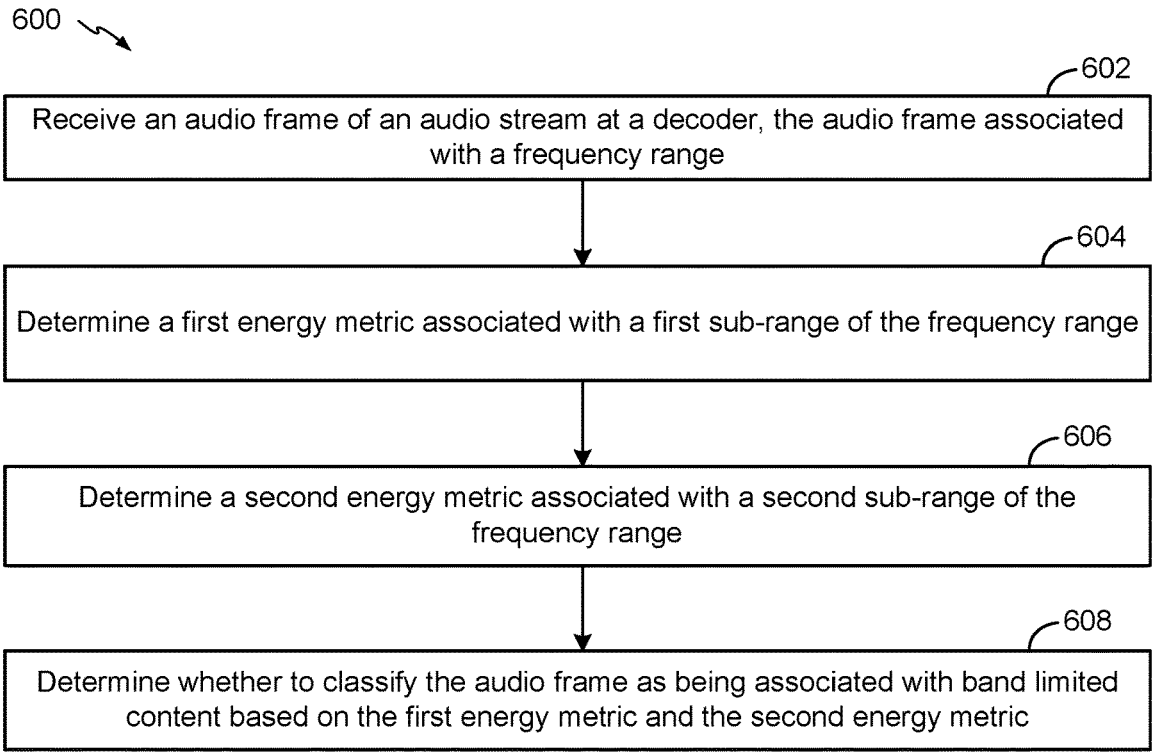
FIG. 6 is a flow chart illustrating an example of a method of classifying an audio frame.

Referring to FIG. 6, a flow chart of a particular illustrative example of a method of processing an audio frame is disclosed and generally designated 600. The audio frame may include or correspond to the audio frame 112 of FIG. 1. For example, the method 600 may be performed by the second device 120 (e.g., the decoder 122, the first decode stage 123, the detector 124, the classifier 126, the second decode stage 132) of FIG. 1, or a combination thereof.

The method 600 includes receiving an audio frame of an audio stream at a decoder, the audio frame associated with a frequency range, at 602. The audio frame may correspond to the audio frame 112 of FIG. 1. The frequency range may be associated with a wideband frequency range (e.g., a wideband bandwidth), such as 0-8 kHz. The wideband frequency range may include a low band frequency range and a high band frequency range.

The method 600 also includes determining a first energy metric associated with a first sub-range of the frequency range, at 604, and determining a second energy metric associated with a second sub-range of the frequency range, at 606. The first energy metric and the second energy metric may be generated by the decoder 122 (e.g., the detector 124) of FIG. 1. The first-sub range may correspond to a portion of a low band (e.g., a narrowband). For example, if the low band has a bandwidth of 0-4 kHz, the first sub-range may have a bandwidth of 0.8-3.6 kHz. The first sub-range may be associated with a low band component of the audio frame. The second sub-range may correspond to a portion of a high band. For example, if the high band has a bandwidth of 4-8 kHz, the second sub-range may have a bandwidth of 4.4-8 kHz. The second sub-range may be associated with a high band component of the audio frame.

The method 600 further includes determining whether to classify the audio frame as being associated with band limited content based on the first energy metric and the second energy metric, at 608. Band limited content may correspond to narrowband content (e.g., low band content) of the audio frame. Content included in the high band of the audio frame may be associated with spectral energy leakage. The first sub-range may include multiple first bands. Each band of the multiple first bands may have the same bandwidth, and determining the first energy metric may include calculating an average energy value of two or more bands of the multiple first bands. The second sub-range may include multiple second bands. Each band of the multiple second bands may have the same bandwidth and determining the second energy metric may include determining a peak energy value of the multiple second bands.

In some implementations, the first sub-range and the second sub-range may be mutually exclusive. For example, the first sub-range and the second sub-range may be separated by a transition band of the frequency range. The transition band may be associated with a high band.

The method 600 may thus enable the decoder to classify whether the audio frame includes band limited content (e.g., narrowband content). The classification of the audio frame as having band limited content may enable the decoder to set an output mode (e.g., a synthesis mode) of the decoder to a narrowband mode. When the output mode is set as the narrowband mode, the decoder may output band limited content (e.g., narrowband content) of received audio frames and may refrain from outputting high band content associated with the received audio frames.

Figure 7:
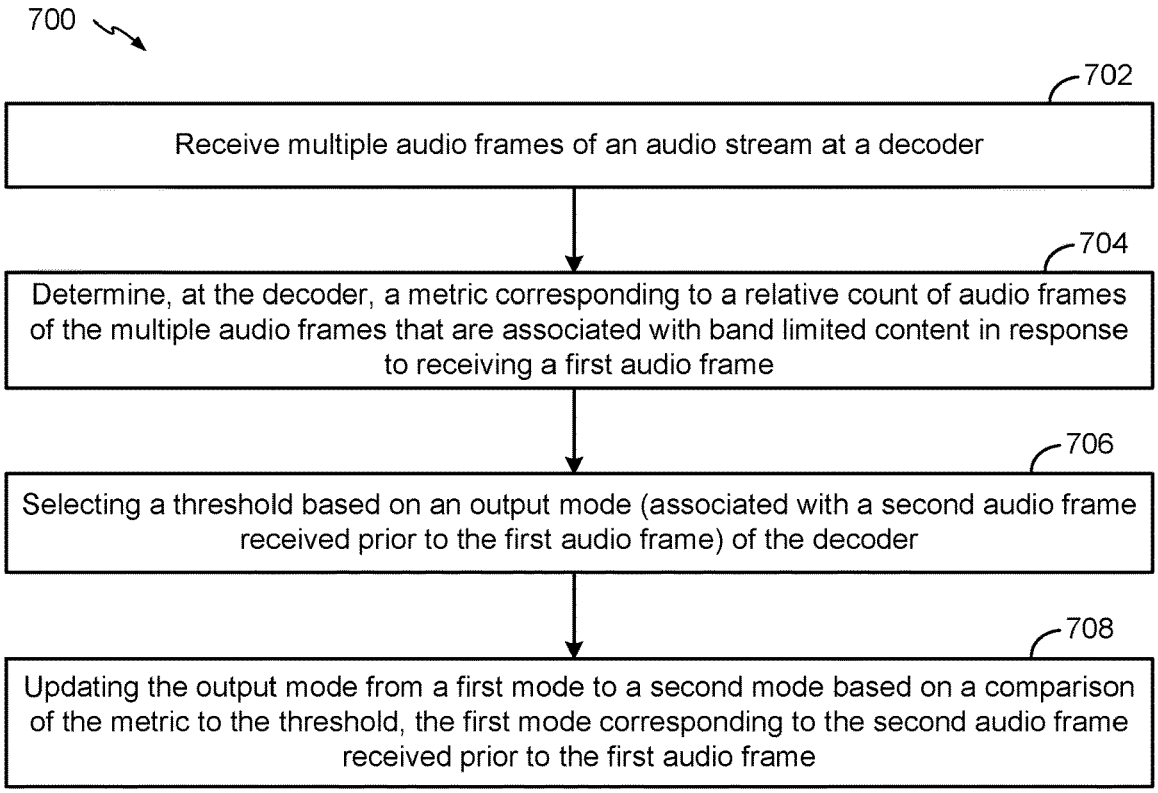
FIG. 7 is a flow chart illustrating another example of a method of operating a decoder.

Referring to FIG. 7, a flow chart of a particular illustrative example of a method of operating a decoder is disclosed and generally designated 700. The decoder may correspond to the decoder 122 of FIG. 1. For example, the method 700 may be performed by the second device 120 (e.g., the decoder 122, the first decode stage 123, the detector 124, the second decode stage 132) of FIG. 1, or a combination thereof.

The method 700 includes receiving multiple audio frames of an audio stream at a decoder, at 702. The multiple audio frames may include the audio frame 112 of FIG. 1. In some implementations, the method 700 may include determining, at the decoder, for each audio frame of the multiple audio frames, whether the frame is associated with band limited content.

The method 700 includes determining, at the decoder, a metric value corresponding to a relative count of audio frames of the multiple audio frames that are associated with band limited content in response to receiving a first audio frame, at 704. For example, the metric value may correspond to a count of NB frames. In some implementations, the metric value (e.g., the count of audio frames classified as being associated with band limited content) may be determined as a percentage of a number of frames (e.g., up to 100 of the most recently received active frames).

The method 700 also includes selecting a threshold based on an output mode (associated with a second audio frame of the audio stream received prior to the first audio frame) of the decoder, at 706. For example, the output mode (e.g., an output mode) may correspond to the output mode 134 of FIG. 1. The output mode may be a wideband mode or a narrowband mode (e.g., a band limited mode). The threshold may correspond to the one or more thresholds 131 of FIG. 1. The threshold may be selected as a wideband threshold having a first value or a narrowband threshold having a second value. The first value may be greater than the second value. In response to determining that the output mode is a wideband mode, the wideband threshold may be selected as the threshold. In response to determining that the output mode is the narrowband mode, the narrowband threshold may be selected as the threshold.

The method 700 may further include updating the output mode from a first mode to a second mode based on a comparison of the metric value to the threshold, at 708.

In some implementations, the first mode may be selected based in part on a second audio frame of the audio stream, the second audio frame received prior to the first audio frame. For example, in response to receiving the second audio frame, the output mode may have been set to the wideband mode (e.g., in this example, the first mode is the wideband mode). Prior to selecting the threshold, the output mode corresponding to the second audio frame may be detected to be the wideband mode. In response to determining the output mode (corresponding to the second audio frame) is the wideband mode, a wideband threshold may be selected as the threshold. If the metric value is greater than or equal to the wideband threshold, the output mode (corresponding to the first audio frame) may be updated to a narrowband mode.

In other implementations, in response to receiving the second audio frame, the output mode may have been set to the narrowband mode (e.g., in this example, the first mode is the narrowband mode). Prior to selecting the threshold, the output mode corresponding to the second audio frame may be detected to be the narrowband mode. In response to determining the output mode (corresponding to the second audio frame) is the narrowband mode, a narrowband threshold may be selected as the threshold. If the metric value is less than or equal to the narrowband threshold, the output mode (corresponding to the first audio frame) may be updated to the wideband mode.

In some implementations, the average energy value associated with the low band component of the first audio frame may correspond to a particular average energy associated with a subset of bands of the low band component of the first audio frame.

In some implementations, the method 700 may include determining, at the decoder, for at least one audio frame of the multiple audio frames indicated as an active frame, whether the at least one audio frame is associated with the band limited content. For example, the decoder 122 may determine that the audio frame 112 is associated with the band limited content based on an energy level of the audio frame 112 as described with reference to FIG. 2.

In some implementations, prior to determining the metric value, the first audio frame may be determined to be an active frame and an average energy value associated with a low band component of the first audio frame may be determined. In response to determining that the average energy value is greater than a threshold energy value and in response to determining that the first audio frame is an active frame, the metric value may be updated from a first value to a second value. After the metric value is updated to the second value, the metric value may be identified as having the second value in response to the first audio frame being received. The method 500 may include identifying the second value in response to the first audio frame being received. For example, the first value may correspond to a wideband threshold and the second value may correspond to a narrowband threshold. The decoder 122 may have been previously set to the wideband threshold, and the decoder may select the narrowband threshold in response to receiving the audio frame 112 as described with reference to FIGS. 1 and 2.

Additionally or alternatively, in response to determining that either the average energy value is less than or equal to the threshold value or that the first audio frame is not an active frame, the metric value may be maintained (e.g., not be updated). In some implementations, the threshold energy value may be based on an average low band energy value of multiple received frames, such as an average of the average low band energy of the past 20 frames (which may or may not include the first audio frame). In some implementations, the threshold energy value may be based on a smoothed average low band energy of multiple active frames received from the beginning of a communication (e.g., a telephone call) (which may or may not include the first audio frame). As an example, the threshold energy value may be based on a smoothed average low band energy of all active frames received from the beginning of the communication. For illustration purposes, a particular example of this smoothing logic may be:

$$\mathrm{avg}_{nrg_{LT}}(n)=0.99*\mathrm{avg}_{nrg_{LT}}(n-1)+0.01*nrg_LB(n),$$

where $\mathrm{avg}_{nrg_{LT}}(n)$ is the smoothed average energy of the low band of all active frames from the beginning (e.g., from frame 0), which is updated based on an average low band energy (nrg_LB(n)) of the current audio frame (frame "n", also referred to in this example as the first audio frame), $\mathrm{avg}_{nrg_{LT}}(n-1)$ is the average energy of low band of all active frames from the beginning excluding the energy of the current frame (e.g., average for active frames from frame 0 to frame "n−1", and excluding frame "n").

Continuing the particular example, the average low band energy (nrg_LB(n)) of the first audio frame may be compared with the smoothed average energy of the low band calculated based on average energy ($\mathrm{avg}_{nrg_{LT}}(n)$) of all the frames preceding the first audio frame and including the average low band energy of the first audio frame, if the average low band energy (nrg_LB(n)) is found to be greater than the smoothed average energy of the low band ($\mathrm{avg}_{nrg_{LT}}(n)$), the metric value described in 700 corresponding to the relative count of audio frames of the multiple audio frames that are associated with band limited content may be updated based on a determination of whether to classify the first audio frame as being associated with wideband content or band limited, such as described with reference to FIG. 6 at 608. If the average low band energy (nrg_LB(n)) is found to be less than or equal to the smoothed average energy of the low band ($\mathrm{avg}_{nrg_{LT}}(n)$), the metric value described with reference to the method 700 corresponding to the relative count of audio frames of the multiple audio frames that are associated with band limited content may not be updated.

In an alternate implementation, the average energy value associated with a low band component of the first audio frame could be replaced with the average energy value associated with a subset of the bands of the low band component of the first audio frame. Additionally, the threshold energy value may also be based on the average of the average low band energy of the past 20 frames (which may or may not include the first audio frame). Alternatively, the threshold energy value may be based on a smoothed average energy value associated with a subset of the bands corresponding to the low band component of all the active frames from the beginning of a communication, such as a telephone call. The active frames may or may not include the first audio frame.

In some implementations, for each audio frame of the multiple audio frames indicated as an inactive frame by the VAD, the decoder may maintain the output mode to be the same as a particular mode of a most recently received active frame.

The method 700 may thus enable the decoder to update (or maintain) the output mode with which to output audio content associated with received audio frame. For example, the decoder may set the output mode to a narrowband mode based on a determination that the received audio frames include band limited content. The decoder may change the output mode from the narrowband mode to the wideband mode in response to detection that the decoder is receiving additional audio frames that do not include band limited content.

Figure 8:
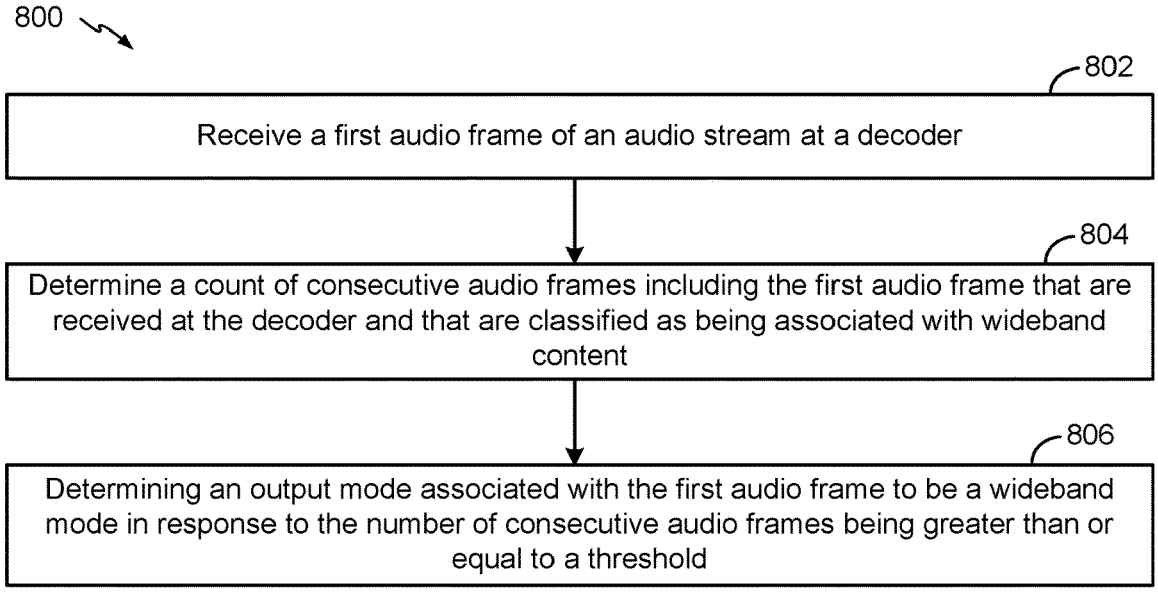
FIG. 8 is a flow chart illustrating another example of a method of operating a decoder.

Referring to FIG. 8, a flow chart of a particular illustrative example of a method of operating a decoder is disclosed and generally designated 800. The decoder may correspond to the decoder 122 of FIG. 1. For example, the method 800 may be performed by the second device 120 (e.g., the decoder 122, the first decode stage 123, the detector 124, the second decode stage 132) of FIG. 1, or a combination thereof.

The method 800 includes receiving a first audio frame of an audio stream at a decoder, at 802. For example, the first audio frame may correspond to the audio frame 112 of FIG. 1.

The method 800 also includes determining a count of consecutive audio frames including the first audio frame that are received at the decoder and that are classified as being associated with wideband content, at 804. In some implementations, the count, referenced at 804, could alternatively be a count of consecutive active frames (classified by received VADs, such as the VAD 140 of FIG. 1) including the first audio frame that are received at the decoder and that are classified as being associated with wideband content. For example, the count of consecutive audio frames may correspond to a number of consecutive wideband frames tracked by the tracker 128 of FIG. 1.

The method 800 further includes determining an output mode associated with the first audio frame to be a wideband mode in response to the count of consecutive audio frames being greater than or equal to a threshold, at 806. The threshold may have a value that is greater than or equal to one. As illustrative, non-limiting examples, the value of the threshold may be twenty.

In an alternative implementation, the method 800 may include maintaining a queue buffer of a specific size, the size of the queue buffer being equal to the threshold (e.g., twenty, as an illustrative, non-limiting example) and updating the queue buffer with the classification (whether associated with wideband content or associated with band limited content) from the classifier 126 of the past consecutive threshold number of frames (or active frames) including the first audio frame's classification. The queue buffer may include or correspond to the tracker 128 (or a component thereof) of FIG. 1. If the number of frames (or active frames) classified as being associated with band limited content, as indicated by the queue buffer, is found to be zero, it is equivalent to determining that the number of consecutive frames (or active frames) including the first frame classified as wideband is greater than or equal to the threshold. For example, the smoothing logic 130 of FIG. 1 may determine whether the number of frames (or active frames) classified as being associated with band limited content, as indicated by the queue buffer, is found to be zero.

In some implementations, in response to receiving the first audio frame, the method 800 may include determining that the first audio frame is an active frame and incrementing a count of received frames. For example, the first audio frame may be determined to be the active frame based on a VAD, such as the VAD 140 of FIG. 1. In some implementations, the count of received frames may be incremented in response to the first audio frame being the active frame. In some implementations, the count of received active frames may be capped at (e.g., limited to) a maximum value. For example, the maximum value may be 100, as an illustrative, non-limiting example.

Additionally, in response to receiving the first audio frame, the method 800 may include determining a classification of the first audio frame as being associated wideband content or narrowband content. The number of consecutive audio frames may be determined after the classification of the first audio frame is determined. After the number of consecutive audio frames is determined, the method 800 may determine whether the count of received frames (or the count of received active frames) is greater than or equal to a second threshold, such as a threshold of fifty, as an illustrative, non-limiting example. The output mode associated with the first audio frame may be determined to be the wideband mode in response to determining that the count of received active frames is less than the second threshold.

In some implementations, the method 800 may include setting the output mode associated with the first audio frame from a first mode to the wideband mode in response to the number of consecutive audio frames being greater than or equal to the threshold. For example, the first mode may be a narrowband mode. In response to setting the output mode from the first mode to the wideband mode based on determining that the number of consecutive audio frames is greater than or equal to the threshold, a count of received audio frames (or a count of received active frames) may be set to an initial value, such as a value of zero, as an illustrative, non-limiting example. Additionally or alternatively, in response to setting the output mode from the first mode to the wideband mode based on determining that the number of consecutive audio frames is greater than or equal to the threshold, a metric value corresponding to the relative count of audio frames of the multiple audio frames that are associated with band limited content, as described with reference to the method 700 of FIG. 7, may be set to an initial value, such as a value of zero, as an illustrative, non-limiting example.

In some implementations, prior to updating the output mode, the method 800 may include determining a previous mode set as the output mode. The previous mode may be associated with a second audio frame of the audio stream that preceded the first audio frame. In response to determining the previous mode is the wideband mode, the previous mode may be maintained and may be associated with the first frame (e.g., the first mode and the second mode may both be the wideband mode). Alternatively, in response to determining the previous mode is the narrowband mode, the output mode may be set (e.g., changed) from the narrowband mode associated with the second audio frame to the wideband mode associated with the first audio frame.

The method 800 may thus enable the decoder to update (or maintain) the output mode (e.g., an output mode) with which to output audio content associated with received audio frame. For example, the decoder may set the output mode to a narrowband mode based on a determination that the received audio frames include band limited content. The decoder may change the output mode from the narrowband mode to the wideband mode in response to detection that the decoder is receiving additional audio frames that do not include band limited content.

In particular aspects, the methods of FIGS. 5-8 may be implemented by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, one or more of the methods of FIGS. 5-8, individually or in combination, may be performed by a processor that executes instructions, as described with respect to FIGS. 9 and 10. To illustrate, a portion of the method 500 of FIG. 5 may be combined with a second portion of one of the methods of FIGS. 6-8.

Figure 9:
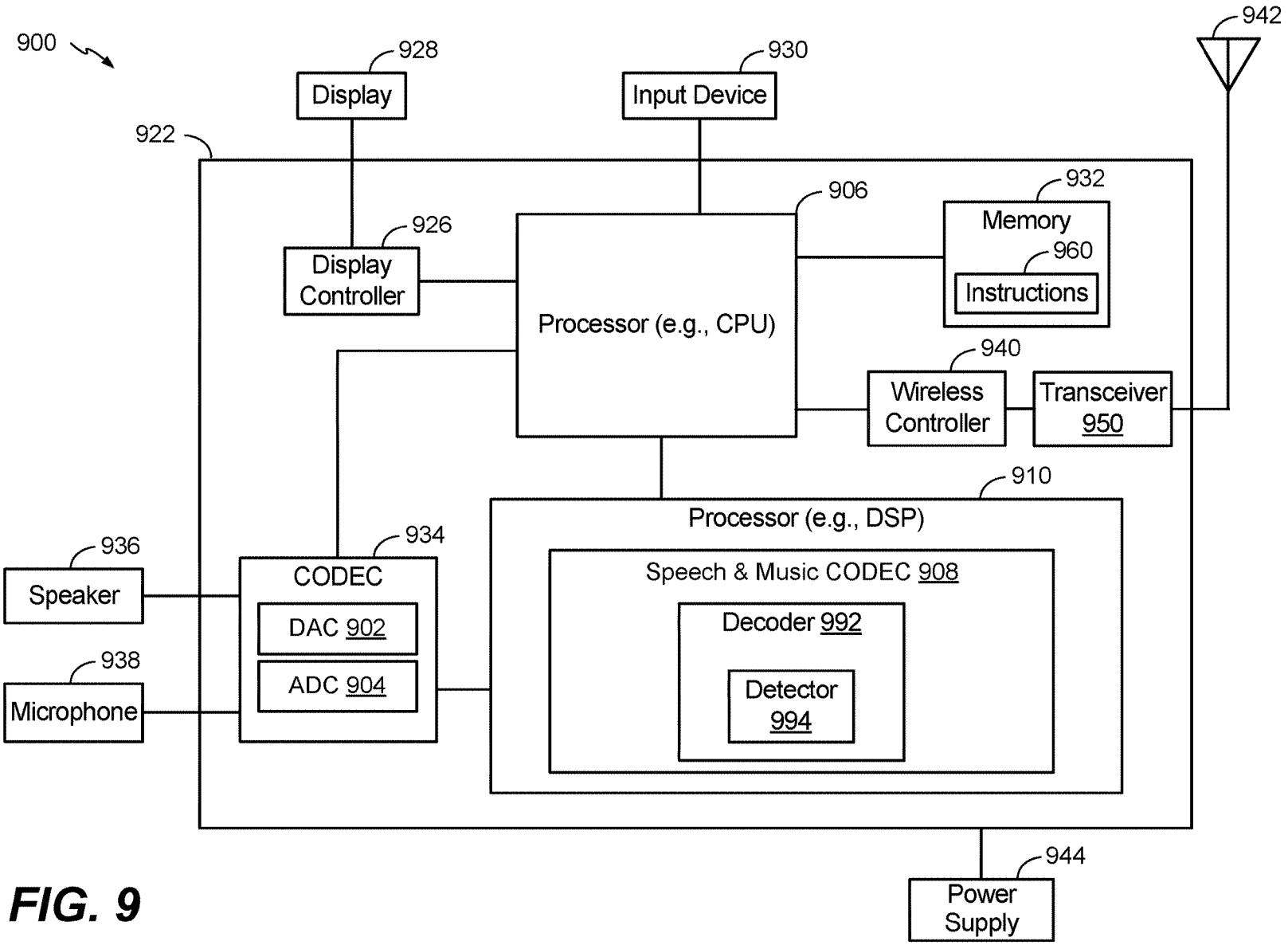
FIG. 9 is a block diagram of a particular illustrative example of a device that is operable to detect band limited content.

Referring to FIG. 9, a block diagram of a particular illustrative example of a device (e.g., a wireless communication device) is depicted and generally designated 900. In various implementations, the device 900 may have more or fewer components than illustrated in FIG. 9. In an illustrative example, the device 900 may correspond to the system of FIG. 1. For example, the device 900 may correspond to the first device 102 or the second device 120 of FIG. 1. In an illustrative example, the device 900 may operate according to one or more of the methods of FIGS. 5-8.

In a particular implementation, the device 900 includes a processor 906 (e.g., a CPU). The device 900 may include one or more additional processors, such as a processor 910 (e.g., a DSP). The processor 910 may include a CODEC 908, such as a speech CODEC, a music CODEC, or a combination thereof. The processor 910 may include one or more components (e.g., circuitry) configured to perform operations of the speech/music CODEC 908. As another example, the processor 910 may be configured to execute one or more computer-readable instructions to perform the operations of the speech/music CODEC 908. Thus, the CODEC 908 may include hardware and software. Although the speech/music CODEC 908 is illustrated as a component of the processor 910, in other examples one or more components of the speech/music CODEC 908 may be included in the processor 906, a CODEC 934, another processing component, or a combination thereof.

The speech/music CODEC 908 may include a decoder 992, such as a vocoder decoder. For example, the decoder 992 may correspond to the decoder 122 of FIG. 1. In a particular aspect, the decoder 992 may include a detector 994 configured to detect whether an audio frame includes band limited content. For example, the detector 994 may correspond to the detector 124 of FIG. 1.

The device 900 may include a memory 932 and the CODEC 934. The CODEC 934 may include a digital-to-analog converter (DAC) 902 and an analog-to-digital converter (ADC) 904. A speaker 936, a microphone 938, or both may be coupled to the CODEC 934. The CODEC 934 may receive analog signals from the microphone 938, convert the analog signals to digital signals using the analog-to-digital converter 904, and provide the digital signals to the speech/music CODEC 908. The speech/music CODEC 908 may process the digital signals. In some implementations, the speech/music CODEC 908 may provide digital signals to the CODEC 934. The CODEC 934 may convert the digital signals to analog signals using the digital-to-analog converter 902 and may provide the analog signals to the speaker 936.

The device 900 may include a wireless controller 940 coupled, via a transceiver 950 (e.g., a transmitter, a receiver, or both), to an antenna 942. The device 900 may include the memory 932, such as a computer-readable storage device. The memory 932 may include instructions 960, such as one or more instructions that are executable by the processor 906, the processor 910, or a combination thereof, to perform one or more of the methods of FIGS. 5-8.

As an illustrative example, the memory 932 may store instructions that, when executed by the processor 906, the processor 910, or a combination thereof, cause the processor 906, the processor 910, or a combination thereof, to perform operations including generating first decoded speech (e.g., the first decoded speech 114 of FIG. 1) associated with an audio frame (e.g., the audio frame 112 of FIG. 1) and determining an output mode of a decoder (e.g., the decoder 122 of FIG. 1 or the decoder 992) based at least in part on a count of audio frames classified as being associated with band limited content. The operations may further include outputting second decoded speech (e.g., the second decoded speech 116 of FIG. 1) based on the first decoded speech, the second decoded speech generated according to the output mode (e.g., the output mode 134 of FIG. 1).

In some implementations, the operations may further include determining a first energy metric associated with a first sub-range of a frequency range associated with the audio frame and determining a second energy metric associated with a second sub-range of the frequency range. The operations may also include determining whether to classify the audio frame (e.g., the audio frame 112 of FIG. 1) as being associated with the narrowband frame or the wideband frame based on the first energy metric and the second energy metric.

In some implementations, the operations may further include classifying the audio frame (e.g., the audio frame 112 of FIG. 1) as a narrowband frame or a wideband frame. The operations may also include determining a metric value corresponding to a second count of audio frames of multiple audio frames (e.g., the audio frames a-i of FIG. 3) that are associated with the band limited content and selecting a threshold based on the metric value.

In some implementations, the operations may further include, in response to receiving a second audio frame of the audio stream, determining a third count of consecutive audio frames received at the decoder classified as having wideband content. The operations may include updating the output mode to a wideband mode in response to the third count of consecutive audio frames being greater than or equal to a threshold.

In some implementations, the memory 932 may include code (e.g., interpreted or complied program instructions) that may be executed by the processor 906, the processor 910, or a combination thereof, to cause the processor 906, the processor 910, or a combination thereof, to perform functions as described with reference to the second device 120 of FIG. 1, to perform at least a portion of one or more of the methods FIGS. 5-8, or a combination thereof. To further illustrate, Example 1 depicts illustrative pseudo-code (e.g., simplified C-code in floating point) that may be compiled and stored in the memory 932. The pseudo-code illustrates a possible implementation of aspects described with respect to FIGS. 1-8. The pseudo-code includes comments which are not part of the executable code. In the pseudo-code, a beginning of a comment is indicated by a forward slash and asterisk (e.g., "/*") and an end of the comment is indicated by an asterisk and a forward slash (e.g., "*/"). To illustrate, a comment "COMMENT" may appear in the pseudo-code as /*COMMENT*/.

In the provided example, the "==" operator indicates an equality comparison, such that "A==B" has a value of TRUE when the value of A is equal to the value of B and has a value of FALSE otherwise. The "&&" operator indicates a logical AND operation. The "||" operator indicates a logical OR operation. The ">" (greater than) operator represents "greater than", the ">=" operator represents "greater than or equal to", and the "<" operator indicates "less than". The term "f" following a number indicates a floating point (e.g., decimal) number format. The "st→A" term indicates that A is a state parameter (i.e., the "→" characters do not represent a logical or arithmetic operation).

In the provided example, "*" may represent a multiplication operation, "+" or "sum" may represent an addition operation, "−" may indicate a subtraction operation, and "/" may represent a division operation. The "=" operator represents an assignment (e.g., "a=1" assigns the value of 1 to the variable "a"). Other implementations may include one or more conditions in addition to or in place of the set of conditions of Example 1.

Example 1

```
/*C-Code modified:*/
if(st->VAD == 1) /*VAD equalling 1 indicates that a received audio
frame is active, the VAC may correspond to the VAD 140 of FIG. 1*/
{
st->flag_NB = 1;
/*Enter the main detector logic to decide bandstoZero*/
}
else
{
st->flag_NB = 0;
/*This occurs if (st-> VAD == 0) which indicates that a received audio
fram is inactive. Do not enter the main detector logic, instead
bandstoZero is set to the last bandstoZero (i.e., use a previous
output mode selection).*/
}
IF(st->flag_NB == 1) /*Main Detector logic for active frames*/
{
  /* set variables */
  Word32 nrgQ31;
  Word32 nrg_band[20], tempQ31, max_nrg;
  Word16 realQ1, imagQ1, flag, offset, WBcnt;
  Word16 perc_detect, perc_miss;
```

-continued

```
Word16 tmp1, tmp2, tmp3, tmp;
realQ1 = 0;
imagQ1 = 0;
set32_fx(nrg_band, 0, 20); /* associated with dividing a wideband
range into 20 bands */
max_nrg = 0;
offset = 50; /*threshold number of frames to be received prior to
calculating a percentage of frames classified as having band limited
content*/
WBcnt = 20; /*threshold to be used to compare to a number of
consecutive received frames having a classification associated with
wideband content */
perc_miss = 80; /* second adaptive threshold as described with
reference to the system 100 of FIG. 1 */
perc_detect = 90; /*first adaptive threshold as described with
reference to the system 100 of FIG. 1 */
st->active_frame_counter=st->active_frame_counter+1;
    if(st ->active_frame_cnt_bwddec > 99)
  {/*Capping the active_frame_cnt to be <= 100*/
    st ->active_frame_cnt_bwddec = 100;
  }
FOR (i = 0; i < 20; i++) /* energy based bandwidth detection
associated with the classifier 126 of FIG. 1 */
{
  nrgQ31 = 0; /* nrgQ31 is associated with an energy value */
  FOR (k = 0; k < nTimeSlots;   k++)
  {
    /* Use quadratiure mirror filter (QMF) analysis buffers
energy in bands */
      realQ1 = rAnalysis[k] [i];
      imagQ1 = iAnalysis[k] [i];
      nrgQ31 = (nrgQ31 + realQ1*realQ1);
      nrgQ31 = (nrgQ31 + imagQ1*imagQ1);
  }
  nrg_band[i] = (nrgQ31);
}
for(i = 2; i < 9; i++)
  /*calculate an average energy associated with the low band. A
subset from 800 Hz to 3600 Hz is used. Compare to a max energy
associated with the high band. Factor of 512 is used (e.g., to
determine an energy ratio threshold).*/
{
  tempQ31 = tempQ31 + w[i]*nrg_band[i]/7.0;
}
for(i = 11; i < 20; i++) /*max_nrg is populated with the maximum
band energy in the subset ofHB bands. Only bands from 4.4 kHz to 8
kHz are considered */
{
  max_nrg = max(max_nrg, nrg_band[i]);
}
if(max_nrg < tempQ31/512.0) /*compare average low band energy to
peak hb energy*/
      flag = 1; /* band limited mode classified*/
else
      flag = 0; /* wideband mode classified*/
/* The parameter flag holds the decision of the classifier 126 */
  /*Update the flag buffer with the latest flag. Push latest flag at
the topmost position of the flag_buffer and shift the rest of the
values by 1, thus the flag_buffer has the last 20 frames' flag info.
The flag buffer may be used to track the number of consecutive frames
classified as having wideband content.*/
FOR(i = 0; i < WBcnt-1; i++)
{
  st->flag_buffer[i] = st->flag_buffer[i+1];
}
st->flag_buffer[WBcnt-1]   =   flag;
st->avg_nrg_LT = 0.99*avg_nrg_LT + 0.01*tempQ31;
if(st->VAD == 0 | | tempQ31 < st->avg_nrg_LT/200)
{
  update_perc = 0;
}
else
{
  update_perc = 1;
}
if(update_perc == 1) /*When reliability creiterion is met.
Determine percentage of classified frames that are associated with
band limited content*/
{
    if(flag == 1) /*If instantaneous decision is met, increase
perc*/
    {
      st->perc_bwddec = st->perc_bwddec + (100-st-
>perc_bwddec)/(active_frame_cnt_bwddec); /*no. of active frames */
  }
  else /*else decrease perc*/
  {
      st->perc_bwddec = st->perc_bwddec - st-
>perc_bwddec/(active_frame_cnt_bwddec);
    }
  }
if(   (st->active_frame_cnt_bwddec > 50)   )
/* Until the active count > 50, do not do change the output mode to
NB. Which means that the default decision is picked which is WideBand
mode as output mode*/
  {
  if (   (st->perc_bwddec >= perc_detect) | | (st->perc_bwddec >=
perc_miss && st->last_flag_filter_NB == 1) && (sum(st->flag_buffer,
WBcnt) > WBcnt_thr))
  {
    /*final decision (output mode) is NB (band limited mode)*/
    st->cldfbSyn_fx->bandsToZero = st->cldfbSyn fx->total_bands -
10;
/*total bands at 16 kHz sampling rate = 20. In effect all bands above
the first 10 bands which correspond to narrowband content may be
attenuated to remove spectral noise leakage*/
    st->last_flag_filter_NB = 1;
  }
  else
  {
    /* final decision is WB */
    st->last_flag_filter_NB = 0;
  }
}
    if(sum_s(st->flag_buffer, WBcnt) == 0)
    /*Whenever the number of consecutive WB frames exceeds WBcnt,
  do not change output mode to NB. In effect the default WB mode
  is picked as the output mode. Whenever WB mode is picked "due to
  number of consecutive frames being WB", reset (e.g., set to an
  initial value) the active_frame_cnt as well as the perc_bwddec
  */
    {
      st->perc_bwddec = 0.0f;
      st->active_frame_cnt_bwddec = 0;
      st->last_flag_filter_NB = 0;
    }
}
else if (st->flag_NB == 0)
/*Detector logic for inactive speech, keep decision same as last
frame*/
{
    st->cldfbSyn_fx->bandsToZero = st->last_frame_bandstoZero;
}
/*After bandstoZero is decided*/
if(st->cldfbSyn_fx->bandsToZero == st->cldfbSyn_fx->total_bands - 10)
{
    /*set all the bands above 4000Hz to 0*/
}
/*Perform QMF synthesis to obtain the final decoded speech after
bandwidth detector*/
```

The memory 932 may include instructions 960 executable by the processor 906, the processor 910, the CODEC 934, another processing unit of the device 900, or a combination thereof, to perform methods and processes disclosed herein, such as one or more of the methods of FIGS. 5-8. One or more components of the system 100 of FIG. 1 may be implemented via dedicated hardware (e.g., circuitry), by a processor executing instructions (e.g., the instructions 960) to perform one or more tasks, or a combination thereof. As an example, the memory 932 or one or more components of the processor 906, the processor 910, the CODEC 934, or a combination thereof, may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 960) that, when executed by a computer (e.g., a processor in the CODEC 934, the processor 906, the processor 910, or a combination thereof), may cause the computer to perform at least a portion of one or more of the methods of FIGS. 5-8. As an example, the memory 932 or the one or more components of the processor 906, the processor 910, the CODEC 934 may be a non-transitory computer-readable medium that includes instructions (e.g., the instructions 960) that, when executed by a computer (e.g., a processor in the CODEC 934, the processor 906, the processor 910, or a combination thereof), cause the computer perform at least a portion of one or more of the methods FIGS. 5-8. For example, a computer-readable storage device may include instructions that, when executed by a processor, may cause the processor to perform operations including generating first decoded speech associated with an audio frame of an audio stream and determining an output mode of a decoder based at least in part on a count of audio frames classified as being associated with band limited content. The operations may also include outputting second decoded speech based on the first decoded speech, the second decoded speech generated according to the output mode.

In a particular implementation, the device 900 may be included in a system-in-package or system-on-chip device 922. In some implementations, the memory 932, the processor 906, the processor 910, the display controller 926, the CODEC 934, the wireless controller 940, and the transceiver 950 are included in a system-in-package or system-on-chip device 922. In some implementations, an input device 930 and a power supply 944 are coupled to the system-on-chip device 922. Moreover, in a particular implementation, as illustrated in FIG. 9, the display 928, the input device 930, the speaker 936, the microphone 938, the antenna 942, and the power supply 944 are external to the system-on-chip device 922. In other implementations, each of the display 928, the input device 930, the speaker 936, the microphone 938, the antenna 942, and the power supply 944 may be coupled to a component of the system-on-chip device 922, such as an interface or a controller of the system-on-chip device 922. In an illustrative example, the device 900 corresponds to a communication device, a mobile communication device, a smartphone, a cellular phone, a laptop computer, a computer, a tablet computer, a personal digital assistant, a set top box, a display device, a television, a gaming console, a music player, a radio, a digital video player, a digital video disc (DVD) player, an optical disc player, a tuner, a camera, a navigation device, a decoder system, an encoder system, a base station, a vehicle, or any combination thereof.

In an illustrative example, the processor 910 may be operable to perform all or a portion of the methods or operations described with reference to FIGS. 1-8. For example, the microphone 938 may capture an audio signal corresponding to a user speech signal. The ADC 904 may convert the captured audio signal from an analog waveform into a digital waveform comprised of digital audio samples. The processor 910 may process the digital audio samples.

An encoder (e.g., a vocoder encoder) of the CODEC 908 may compress digital audio samples corresponding to the processed speech signal and may form a sequence of packets (e.g. a representation of the compressed bits of the digital audio samples). The sequence of packets may be stored in the memory 932. The transceiver 950 may modulate each packet of the sequence and may transmit the modulated data via the antenna 942.

As a further example, the antenna 942 may receive incoming packets corresponding to a sequence of packets sent by another device via a network. The incoming packets may include an audio frame (e.g., an encoded audio frame), such as the audio frame 112 of FIG. 1. The decoder 992 may decompress and decode the receive packet to generate reconstructed audio samples (e.g., corresponding to a synthesized audio signal, such as the first decoded speech 114 of FIG. 1). The detector 994 may be configured to detect whether an audio frame includes band limited content, to classify the frame as being associated with wideband content or narrowband content (e.g., band limited content), or a combination thereof. Additionally or alternatively, the detector 994 may select an output mode, such as the output mode 134 of FIG. 1, that indicates whether an audio output of the decoder is to be NB or WB. The DAC 902 may convert an output of the decoder 992 from a digital waveform to an analog waveform and may provide the converted waveform to the speaker 936 for output.

Figure 10:
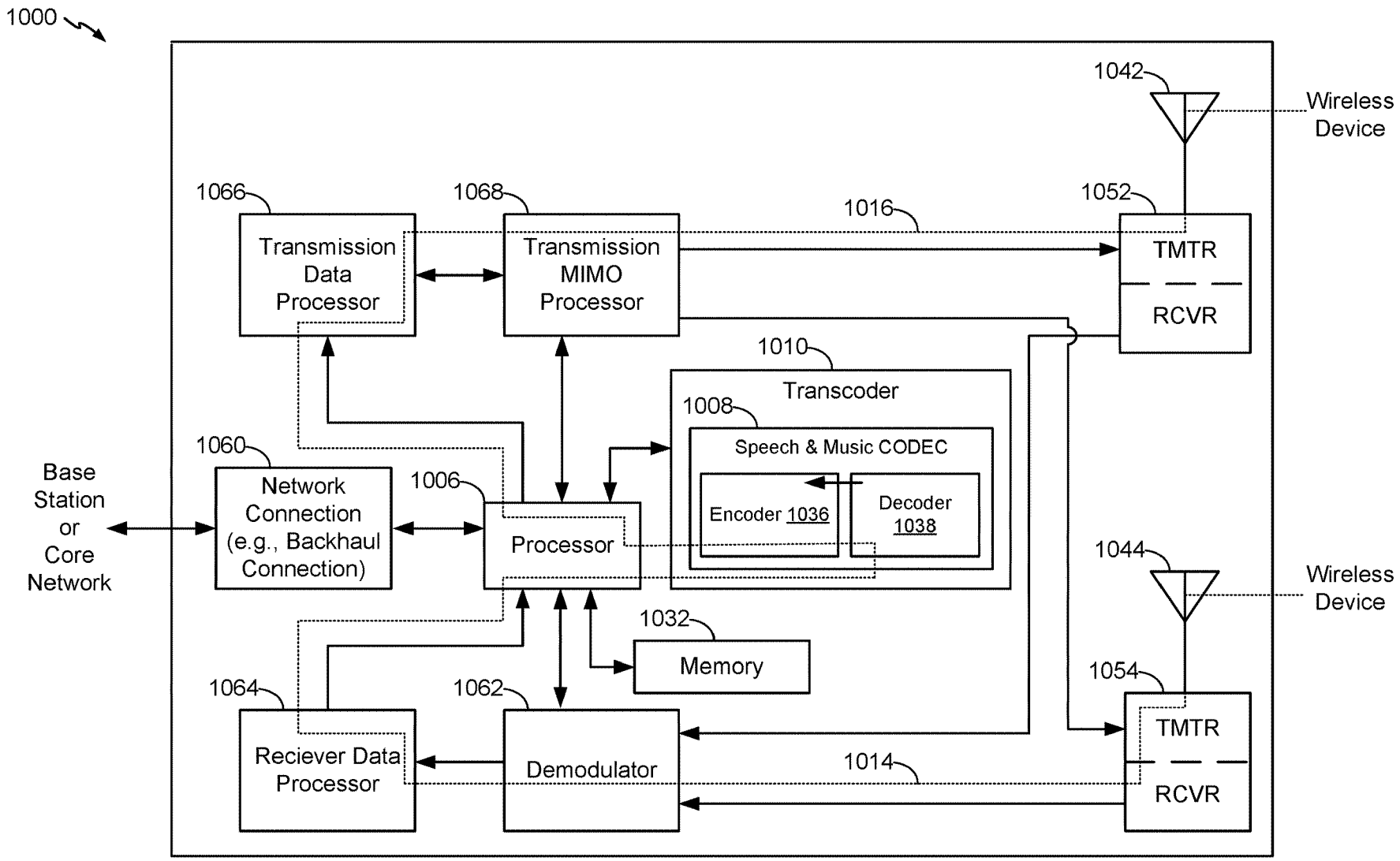
FIG. 10 is a block diagram of a particular illustrative aspect of a base station that is operable to select an encoder.

Referring to FIG. 10, a block diagram of a particular illustrative example of a base station 1000 is depicted. In various implementations, the base station 100 may have more components or fewer components than illustrated in FIG. 10. In an illustrative example, the base station 1000 may include the second device 120 of FIG. 1. In an illustrative example, the base station 1000 may operate according to one or more of the methods of FIGS. 5-6, one or more of the Examples 1-5, or a combination thereof.

The base station 1000 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 900 of FIG. 9.

Various functions may be performed by one or more components of the base station 1000 (and/or in other components not shown), such as sending and receiving messages and data (e.g., audio data). In a particular example, the base station 1000 includes a processor 1006 (e.g., a CPU). The base station 1000 may include a transcoder 1010. The transcoder 1010 may include a speech and music CODEC 1008. For example, the transcoder 1010 may include one or more components (e.g., circuitry) configured to perform operations of the speech and music CODEC 1008. As another example, the transcoder 1010 may be configured to execute one or more computer-readable instructions to perform the operations of the speech and music CODEC 1008.

Although the speech and music CODEC 1008 is illustrated as a component of the transcoder 1010, in other examples one or more components of the speech and music CODEC 1008 may be included in the processor 1006, another processing component, or a combination thereof. For example, a decoder 1038 (e.g., a vocoder decoder) may be included in a receiver data processor 1064. As another example, an encoder 1036 (e.g., a vocoder decoder) may be included in a transmission data processor 1066.

The transcoder 1010 may function to transcode messages and data between two or more networks. The transcoder 1010 may be configured to convert message and audio data from a first format (e.g., a digital format) to a second format. To illustrate, the decoder 1038 may decode encoded signals having a first format and the encoder 1036 may encode the decoded signals into encoded signals having a second format. Additionally or alternatively, the transcoder 1010 may be configured to perform data rate adaptation. For example, the transcoder 1010 may downconvert a data rate or upconvert the data rate without changing a format the audio data. To illustrate, the transcoder 1010 may downconvert 64 kbit/s signals into 16 kbit/s signals.

The speech and music CODEC 1008 may include the encoder 1036 and the decoder 1038. The encoder 1036 may include a detector and multiple encoding stages, as described with reference to FIG. 9. The decoder 1038 may include a detector and multiple decoding stages.

The base station 1000 may include a memory 1032. The memory 1032, such as a computer-readable storage device, may include instructions. The instructions may include one or more instructions that are executable by the processor 1006, the transcoder 1010, or a combination thereof, to perform one or more of the methods of FIGS. 5-6, the Examples 1-5, or a combination thereof. The base station 1000 may include multiple transmitters and receivers (e.g., transceivers), such as a first transceiver 1052 and a second transceiver 1054, coupled to an array of antennas. The array of antennas may include a first antenna 1042 and a second antenna 1044. The array of antennas may be configured to wirelessly communicate with one or more wireless devices, such as the device 900 of FIG. 9. For example, the second antenna 1044 may receive a data stream 1014 (e.g., a bit stream) from a wireless device. The data stream 1014 may include messages, data (e.g., encoded speech data), or a combination thereof.

The base station 1000 may include a network connection 1060, such as backhaul connection. The network connection 1060 may be configured to communicate with a core network or one or more base stations of the wireless communication network. For example, the base station 1000 may receive a second data stream (e.g., messages or audio data) from a core network via the network connection 1060. The base station 1000 may process the second data stream to generate messages or audio data and provide the messages or the audio data to one or more wireless device via one or more antennas of the array of antennas or to another base station via the network connection 1060. In a particular implementation, the network connection 1060 may be a wide area network (WAN) connection, as an illustrative, non-limiting example.

The base station 1000 may include a demodulator 1062 that is coupled to the transceivers 1052, 1054, the receiver data processor 1064, and the processor 1006, and the receiver data processor 1064 may be coupled to the processor 1006. The demodulator 1062 may be configured to demodulate modulated signals received from the transceivers 1052, 1054 and to provide demodulated data to the receiver data processor 1064. The receiver data processor 1064 may be configured to extract a message or audio data from the demodulated data and send the message or the audio data to the processor 1006.

The base station 1000 may include a transmission data processor 1066 and a transmission multiple input-multiple output (MIMO) processor 1068. The transmission data processor 1066 may be coupled to the processor 1006 and the transmission MIMO processor 1068. The transmission MIMO processor 1068 may be coupled to the transceivers 1052, 1054 and the processor 1006. The transmission data processor 1066 may be configured to receive the messages or the audio data from the processor 1006 and to code the messages or the audio data based on a coding scheme, such as CDMA or orthogonal frequency-division multiplexing (OFDM), as an illustrative, non-limiting examples. The transmission data processor 1066 may provide the coded data to the transmission MIMO processor 1068.

The coded data may be multiplexed with other data, such as pilot data, using CDMA or OFDM techniques to generate multiplexed data. The multiplexed data may then be modulated (i.e., symbol mapped) by the transmission data processor 1066 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 1006.

The transmission MIMO processor 1068 may be configured to receive the modulation symbols from the transmission data processor 1066 and may further process the modulation symbols and may perform beamforming on the data. For example, the transmission MIMO processor 1068 may apply beamforming weights to the modulation symbols. The beamforming weights may correspond to one or more antennas of the array of antennas from which the modulation symbols are transmitted.

During operation, the second antenna 1044 of the base station 1000 may receive a data stream 1014. The second transceiver 1054 may receive the data stream 1014 from the second antenna 1044 and may provide the data stream 1014 to the demodulator 1062. The demodulator 1062 may demodulate modulated signals of the data stream 1014 and provide demodulated data to the receiver data processor 1064. The receiver data processor 1064 may extract audio data from the demodulated data and provide the extracted audio data to the processor 1006.

The processor 1006 may provide the audio data to the transcoder 1010 for transcoding. The decoder 1038 of the transcoder 1010 may decode the audio data from a first format into decoded audio data and the encoder 1036 may encode the decoded audio data into a second format. In some implementations, the encoder 1036 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 1010, the transcoding operations (e.g., decoding and encoding) may be performed by multiple components of the base station 1000. For example, decoding may be performed by the receiver data processor 1064 and encoding may be performed by the transmission data processor 1066.

The decoder 1038 and the encoder 1036 may determine, on a frame-by-frame basis, whether each received frame of the data stream 1014 corresponds to a narrowband frame or a wideband frame and may select a corresponding decoding output mode (e.g., a narrowband output mode or a wideband output mode) and a corresponding encoding output mode to transcode (e.g., decode and encode) the frame. Encoded audio data generated at the encoder 1036, such as transcoded data, may be provided to the transmission data processor 1066 or the network connection 1060 via the processor 1006.

The transcoded audio data from the transcoder 1010 may be provided to the transmission data processor 1066 for coding according to a modulation scheme, such as OFDM, to generate the modulation symbols. The transmission data processor 1066 may provide the modulation symbols to the transmission MIMO processor 1068 for further processing and beamforming. The transmission MIMO processor 1068 may apply beamforming weights and may provide the modulation symbols to one or more antennas of the array of antennas, such as the first antenna 1042 via the first transceiver 1052. Thus, the base station 1000 may provide a transcoded data stream 1016, that corresponds to the data stream 1014 received from the wireless device, to another wireless device. The transcoded data stream 1016 may have a different encoding format, data rate, or both, than the data stream 1014. In other implementations, the transcoded data stream 1016 may be provided to the network connection 1060 for transmission to another base station or a core network.

The base station 1000 may therefore include a computer-readable storage device (e.g., the memory 1032) storing instructions that, when executed by a processor (e.g., the processor 1006 or the transcoder 1010), cause the processor to perform operations including generating first decoded speech associated with an audio frame of an audio stream and determining an output mode of a decoder based at least in part on a count of audio frames classified as being associated with band limited content. The operations may also include outputting second decoded speech based on the first decoded speech, the second decoded speech generated according to the output mode.

In conjunction with the described aspects, an apparatus may include means for generating first decoded speech associated with an audio frame. For example, the means for generating may include or correspond to the decoder 122, the first decode stage 123 of FIG. 1, the CODEC 934, the speech/music CODEC 908, the decoder 992, one or more of the processors 906, 910 programmed to execute the instructions 960 of FIG. 9, the processor 1006 or the transcoder 1010 of FIG. 10, one or more other structures, devices, circuits, modules, or instructions to generate the first decoded speech, or a combination thereof.

The apparatus may also include means for determining an output mode of a decoder based at least in part on a number of audio frames classified as being associated with band limited content. For example, the means for determining may include or correspond to the decoder 122, the detector 124, the smoothing logic 130 of FIG. 1, the CODEC 934, the speech/music CODEC 908, the decoder 992, the detector 994, one or more of the processors 906, 910 programmed to execute the instructions 960 of FIG. 9, the processor 1006 or the transcoder 1010 of FIG. 10, one or more other structures, devices, circuits, modules, or instructions to determine an output mode, or a combination thereof.

The apparatus may also include means for outputting second decoded speech based on the first decoded speech. The second decoded speech may be generated according to the output mode. For example, the means for outputting may include or correspond to the decoder 122, the second decode stage 132 of FIG. 1, the CODEC 934, the speech/music CODEC 908, the decoder 992, one or more of the processors 906, 910 programmed to execute the instructions 960 of FIG. 9, the processor 1006 or the transcoder 1010 of FIG. 10, one or more other structures, devices, circuits, modules, or instructions to output the second decoded speech, or a combination thereof.

The apparatus may include means for determining a metric value corresponding to a count of audio frames of multiple audio frames that are associated with the band limited content. For example, the means for determining a metric value may include or correspond to the decoder 122, the classifier 126 of FIG. 1, the decoder 992, one or more of the processors 906, 910 programmed to execute the instructions 960 of FIG. 9, the processor 1006 or the transcoder 1010 of FIG. 10, one or more other structures, devices, circuits, modules, or instructions to determine the metric value, or a combination thereof.

The apparatus may also include means for selecting a threshold based on the metric value. For example, the means for selecting a threshold may include or correspond to the decoder 122, the smoothing logic 130 of FIG. 1, the decoder 992, one or more of the processors 906, 910 programmed to execute the instructions 960 of FIG. 9, the processor 1006 or the transcoder 1010 of FIG. 10, one or more other structures, devices, circuits, modules, or instructions to selecting the threshold based on the metric value, or a combination thereof.

The apparatus may further include means for updating the output mode from a first mode to a second mode based on a comparison of the metric value to the threshold. For example, the means for updating the output mode may include or correspond to the decoder 122, the smoothing logic 130 of FIG. 1, the decoder 992, one or more of the processors 906, 910 programmed to execute the instructions 960 of FIG. 9, the processor 1006 or the transcoder 1010 of FIG. 10, one or more other structures, devices, circuits, modules, or instructions to update the output mode, or a combination thereof.

In some implementations, the apparatus may include means for determining a number of consecutive audio frames that are received at the means for generating the first decoded speech and that are classified as being associated with wideband content. For example, the means for determining the number of consecutive audio frames may include or correspond to the decoder 122, the tracker 128 of FIG. 1, the decoder 992, one or more of the processors 906, 910 programmed to execute the instructions 960 of FIG. 9, the processor 1006 or the transcoder 1010 of FIG. 10, one or more other structures, devices, circuits, modules, or instructions to determine the number of consecutive audio frames, or a combination thereof.

In some implementations, the means for generating first decoded speech may include or correspond to a speech model, and the means for determining an output mode and the means for outputting second decoded speech may each include or correspond to a processor and a memory storing instructions that are executable by the processor. Additionally or alternatively, the means for generating first decoded speech, the means for determining an output mode, and the means for outputting second decoded speech may be integrated into a decoder, a set top box, a music player, a video player, an entertainment unit, a navigation device, a communications device, a personal digital assistant (PDA), a computer, or a combination thereof.

In the aspects of the description described above, various functions performed have been described as being performed by certain components or modules, such as components or module of the system 100 of FIG. 1, the device 900 of FIG. 9, the base station 1000 of FIG. 10, or a combination thereof. However, this division of components and modules is for illustration only. In alternative examples, a function performed by a particular component or module may instead be divided amongst multiple components or modules. Moreover, in other alternative examples, two or more components or modules of FIGS. 1, 9, and 10 may be integrated into a single component or module. Each component or module illustrated in FIGS. 1, 9 and 10 may be implemented using hardware (e.g., an ASIC, a DSP, a controller, a FPGA device, etc.), software (e.g., instructions executable by a processor), or any combination thereof.

Those of skill would further appreciate that the various illustrative logical blocks, configurations, modules, circuits, and algorithm steps described in connection with the aspects disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, such implementation decisions are not to be interpreted as causing a departure from the scope of the present disclosure.

The steps of a method or algorithm described in connection with the aspects disclosed herein may be included directly in hardware, in a software module executed by a processor, or in a combination of the two. A software module may reside in RAM, flash memory, ROM, PROM, EPROM, EEPROM, registers, hard disk, a removable disk, a CD-ROM, or any other form of non-transient storage medium known in the art. A particular storage medium may be coupled to the processor such that the processor may read information from, and write information to, the storage medium. In the alternative, the storage medium may be integral to the processor. The processor and the storage medium may reside in an ASIC. The ASIC may reside in a computing device or a user terminal. In the alternative, the processor and the storage medium may reside as discrete components in a computing device or user terminal.

The previous description is provided to enable a person skilled in the art to make or use the disclosed aspects. Various modifications to these aspects will be readily apparent to those skilled in the art, and the principles defined herein may be applied to other aspects without departing from the scope of the disclosure. Thus, the present disclosure is not intended to be limited to the aspects shown herein and is to be accorded the widest scope possible consistent with the principles and novel features as defined by the following claims.

What is claimed is:

1. A device comprising:

a receiver configured to receive an audio frame of an audio stream; and a decoder configured to:

generate first decoded speech associated with an audio frame of the audio stream, the audio frame including information that indicates a coded bandwidth of the audio frame;

determine an output mode of the decoder based at least in part on the information that indicates the coded bandwidth and based on a count of received active audio frames;

receiving multiple audio frames of the audio stream at the decoder, the multiple audio frames including the audio frame and a second audio frame determining, at the decoder in response to receiving the second audio frame, a metric value corresponding to a relative count of audio frames of the multiple audio frames that are associated with a particular bandwidth;

selecting a threshold based on a first mode of the output mode of the decoder, the first mode associated with the audio frame received prior to the second audio frame; and updating the output mode from the first mode to a second mode based on a comparison of the metric value to the threshold, the second mode associated with the second audio frame; and output second decoded speech based on the first decoded speech, the second decoded speech generated according to the output mode.

2. The device of claim 1, wherein the decoder is configured to classify the audio frame as a narrowband frame or a wideband frame, and wherein a classification of a narrowband frame corresponds to the audio frame being associated with band limited content.

3. The device of claim 1, wherein the coded bandwidth of the audio frame indicates a first bandwidth of the audio frame, wherein the audio frame is based on input audio data having a second bandwidth, wherein the first bandwidth is greater than the second bandwidth, and wherein the second decoded speech has the second bandwidth.

4. The device of claim 1, wherein the second decoded speech corresponds to the first decoded speech when the output mode comprises a wideband mode, wherein the first decoded speech is generated based on the information that indicates the coded bandwidth, and wherein the first decided speech has a first bandwidth corresponding to the coded bandwidth.

5. The device of claim 1, wherein the second decoded speech includes a portion of the first decoded speech when the output mode comprises a narrowband mode.

6. The device of claim 1, wherein the count of audio frames includes a count of received active audio frames, a count of consecutive wideband frames, a count of consecutive band limited frames, a relative count of wideband frames, a relative count of band limited frames, or a combination thereof.

7. The device of claim 1, wherein the decoder includes:

a classifier configured to classify the audio frame as wideband content or band limited content; and a tracker configured to maintain a record of one or more classifications generated by the classifier, wherein the tracker includes at least one of a buffer, a memory, or one or more counters.

8. The device of claim 1, wherein the receiver and the decoder are integrated into a mobile communication device or a base station.

9. The device of claim 1, further comprising:

a demodulator coupled to the receiver, the demodulator configured to demodulate the audio stream;

a processor coupled to the demodulator; and an encoder coupled to the processor.

10. The device of claim 9, wherein the receiver, the decoder, the demodulator, the processor, and the encoder are integrated into a mobile communication device.

11. The device of claim 9, wherein the receiver, the decoder, the demodulator, the processor, and the encoder are integrated into a base station.

12. A method of decoder operation, the method comprising:

generating, at a decoder, first decoded speech associated with an audio frame of an audio stream, the audio frame including information that indicates a coded bandwidth of the audio frame;

classifying, based on the energy level, the audio frame as a wideband frame or a band limited frame, wherein classifying the audio frame based on the energy level includes:

determining a ratio value that is based on a first energy metric associated with the low band component and a second energy metric associated with the high band component;

comparing the ratio value to a classification threshold; and classifying the audio frame as the band limited frame in response to the ratio value being greater than the classification threshold;

determining an output mode of the decoder based at least in part on a) the classification of the audio frame as the wideband frame or the band limited frame and b) the information that indicates the coded bandwidth, wherein a bandwidth mode indicated by the output mode of the decoder is different than a bandwidth mode indicated by the information that indicates the coded bandwidth; and outputting second decoded speech based on the first decoded speech, the second decoded speech generated according to the output mode.

13. The method of claim 12, further comprising, when the audio frame is classified as the band limited frame, attenuating the high band component of the first decoded speech to generate the second decoded speech.

14. The method of claim 12, further comprising, when the audio frame is classified as the band limited frame, setting an energy value of one or more bands associated with the high band component to zero to generate the second decoded speech.

15. The method of claim 12, further comprising determining the first energy metric associated with a first set of multiple frequency bands associated with the low band component of the first decoded speech.

16. The method of claim 15, wherein determining the first energy metric comprises determining an average energy value of a subset of bands of the first set of multiple frequency bands and setting the first energy metric equal to the average energy value.

17. The method of claim 12, further comprising determining the second energy metric associated with a second set of multiple frequency bands associated with the high band component of the first decoded speech.

18. The method of claim 17, further comprising:

determining a particular frequency band of the second set of multiple frequency bands having a highest detected energy value; and setting the second energy metric equal to the highest detected energy value.

19. The method of claim 12, wherein, when the output mode comprises a wideband mode, the second decoded speech is substantially the same as the first decoded speech.

20. The method of claim 12, wherein determining the output mode of the decoder is performed in response to determining that the audio frame is an active frame.

21. The method of claim 12, further comprising:

receiving a second audio frame of the audio stream at the decoder; and maintaining the output mode of the decoder in response to determining that the second audio frame is an inactive frame.

22. A method of decoder operation, the method comprising:

generating, at a decoder, first decoded speech associated with an audio frame of an audio stream, the audio frame including information that indicates a coded bandwidth of the audio frame;

determining an output mode of the decoder based at least in part on the information that indicates the coded bandwidth and based on a count of received active audio frames;

receiving multiple audio frames of the audio stream at the decoder, the multiple audio frames including the audio frame and a second audio frame;

determining, at the decoder in response to receiving the second audio frame, a metric value corresponding to a relative count of audio frames of the multiple audio frames that are associated with a particular bandwidth;

selecting a threshold based on a first mode of the output mode of the decoder, the first mode associated with the audio frame received prior to the second audio frame; and updating the output mode from the first mode to a second mode based on a comparison of the metric value to the threshold, the second mode associated with the second audio frame; and outputting second decoded speech based on the first decoded speech, the second decoded speech generated according to the output mode.

23. The method of claim 22, further comprising classifying the audio frame based on a ratio value, the ratio value based on a first energy metric associated with a low band component of the first decoded speech and based on a second energy metric associated with a high band component of the first decoded speech, wherein the output mode is determined further based on a classification of the audio frame.

24. The method of claim 22, wherein the metric value is determined as a percentage of the multiple audio frames that are classified as being associated with the particular bandwidth, wherein the threshold is selected as a wideband threshold having a first value or a narrowband threshold having a second value, and wherein the first value is greater than the second value.

25. The method of claim 22, further comprising:

prior to determining the metric value:

determining that the second audio frame is an active frame; and determining an average energy value associated with a low band component of the second audio frame; and in response to determining that the average energy value is greater than a threshold energy value and in response to determining that the second audio frame is the active frame, updating the metric value from a first value to a second value, wherein determining the metric value includes updating the metric value.

26. The method of claim 22, further comprising:

determining, at the decoder, a metric value based on or more counts of audio frames; and selecting a threshold based on a previous output mode of the decoder, wherein determining the output mode of the decoder is further based on a comparison of the metric value to the threshold.

27. The method of claim 22, wherein the decoder is included in a device that comprises a mobile communication device or a base station.

* * * * *